US010934058B2

(12) United States Patent
Cobler

(10) Patent No.: US 10,934,058 B2
(45) **Date of Patent: *Mar. 2, 2021**

(54) EXTENDED HEM FOLD DRAWSTRING BAG

(71) Applicant: Poly-America, L.P., Grand Prairie, TX (US)

(72) Inventor: Brad A. Cobler, Irving, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/883,680

(22) Filed: Oct. 15, 2015

(65) Prior Publication Data

US 2016/0031610 A1 Feb. 4, 2016

Related U.S. Application Data

(63) Continuation of application No. 13/688,369, filed on Nov. 29, 2012, which is a continuation-in-part of application No. 13/222,180, filed on Aug. 31, 2011, now abandoned.

(51) Int. Cl.

| | |
|---|---|
| ***B65D 33/28*** | (2006.01) |
| ***B65D 33/02*** | (2006.01) |
| ***B65F 1/00*** | (2006.01) |

(52) U.S. Cl.

CPC ..... *B65D 33/28* (2013.01); *B65D 33/02* (2013.01); *B65F 1/002* (2013.01)

(58) Field of Classification Search

CPC ..... B65D 33/28; B65F 1/002

See application file for complete search history.

(56) References Cited

U.S. PATENT DOCUMENTS

| | | | | |
|---|---|---|---|---|
| 4,493,683 | A * | 1/1985 | Jostler | B26D 7/01 156/70 |
| 4,878,764 | A * | 11/1989 | Meyer | A45C 3/04 383/7 |
| 4,883,675 | A * | 11/1989 | Wernz | B65D 31/12 206/568 |
| 5,184,897 | A * | 2/1993 | Gozdenovich | B65D 33/28 383/120 |
| 5,716,137 | A * | 2/1998 | Meyer | B65D 33/28 383/10 |
| 6,550,966 | B1 * | 4/2003 | Saad | B65D 31/04 383/100 |
| 6,561,696 | B1 * | 5/2003 | Rusnak | B65D 33/28 383/75 |
| 7,914,207 | B1 * | 3/2011 | Beam | B31B 19/90 220/495.11 |
| 2004/0202388 | A1 * | 10/2004 | Rusnak | B65F 1/0006 383/71 |

(Continued)

*Primary Examiner* — Derek J Battisti

(74) *Attorney, Agent, or Firm* — Daniel J. Layden; Brandon J. Lee

(57) ABSTRACT

The present invention is directed to a thermoplastic bag comprised of a front panel and a back panel. The front panel and back panel are generally joined along a first side edge, a second side edge, and a bottom edge of the respective front panel and back panel. The front panel has a distal edge with the distal edge folded over the front panel to provide a hem and an overlap area immediately below the first hem. The overlap area comprises at least two layers of polymeric film which are sealed together.

15 Claims, 21 Drawing Sheets

(56) References Cited

U.S. PATENT DOCUMENTS

Figure 1:
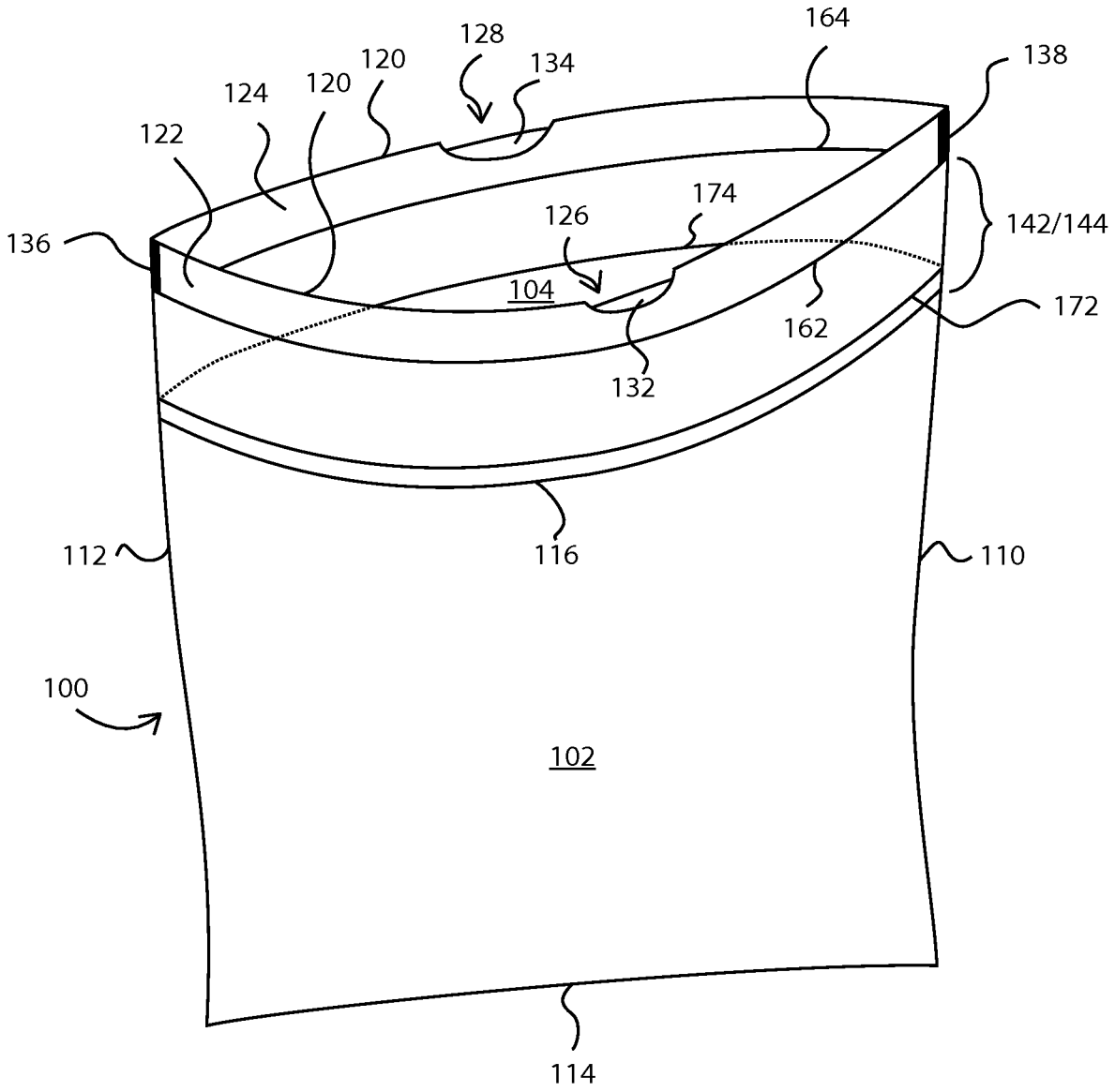

| | | | | |
|---|---|---|---|---|
| 2005/0207681 | A1* | 9/2005 | Raterman | B65F 1/0006 383/75 |
| 2010/0111452 | A1* | 5/2010 | Ross | B65D 33/28 383/75 |
| 2011/0117307 | A1* | 5/2011 | Fraser | B32B 37/0076 428/66.6 |
| 2013/0330025 | A1* | 12/2013 | Broering | B65D 33/165 383/75 |

* cited by examiner

EXTENDED HEM FOLD DRAWSTRING BAG

CROSS-REFERENCE TO RELATED APPLICATIONS

The present application is a continuation of currently pending U.S. patent application Ser. No. 13/688,369 filed Nov. 29, 2012 which is a continuation-in-part of now abandoned U.S. patent application Ser. No. 13/222,180 filed Aug. 31, 2011. Priority is claimed to both of these aforementioned applications and both applications, U.S. patent application Ser. No. 13/688,369 and U.S. patent application Ser. No. 13/222,180, are hereby incorporated by reference into this disclosure.

BACKGROUND OF THE INVENTION

1. Field of the Invention

The present invention relates to improvements in the construction and manufacture of polymeric bags. In particular, the present invention relates to improvements to trash bags.

2. Description of the Related Art

Polymeric bags are ubiquitous in modern society and are available in countless combinations of varying capacities, thicknesses, dimensions and colors. The bags are available for numerous applications including typical consumer applications such as long-term storage, food storage, and trash collection. Like many other consumer products, increased demand and new technology have driven innovations in polymeric bags improving the utility and performance of such bags. The present invention is an innovation of particular relevance to polymeric bags used for trash collection.

Polymeric bags are manufactured from polymeric film produced using one of several manufacturing techniques well-known in the art. The two most common methods for manufacture of polymeric films are blown-film extrusion and cast-film extrusion. In blown-film extrusion the resulting film is tubular while cast-film extrusion produces a generally planar film. Regardless of the manufacturing method utilized, the present invention is generally applicable to drawstring trash bags typically manufactured from a continuous web of plastic film. Manufacturing methods for the production of drawstring bags from a web of material are shown in numerous prior art references including, but not limited to, U.S. Pat. Nos. 3,196,757 and 4,624,654, which are hereby incorporated by reference.

Drawstring trash bags are frequently used in connection with rigid containers. When used with a rigid container, it is common to fold the upper opening of a drawstring trash bag over the upper rim of the container to keep the upper opening of the bag accessible. Some rigid containers provide retaining devices to hold the upper opening of a drawstring bag in place while, in other instances, the drawstring bag may provide certain features or properties that facilitate keeping the bag in place on the container. The use of these rigid containers is particularly common in connection with 13-gallon drawstring bags typically used in the household or in an office environment. Rigid containers may also be used with larger bags, such as those commonly used for the collection of outdoor or yard waste. When drawstring bags are used with supporting rigid containers, the drawstring trash bag is often filled with trash and other debris until the capacity of the container or trash bag is reached.

After filling the drawstring bag with trash or debris, the bag and its contents are generally pulled out of the rigid container in one of several ways. Some consumers may prefer to pull the drawstrings taut, using the drawstrings to pull the bag and its contents out of the container. However, in many cases, consumers pull the bag out of the rigid container before pulling the drawstrings taut. In such cases, a consumer will typically grab the upper opening of the bag hem or, more commonly, the area immediately below the hem. As the consumer grabs the bag and pulls it out of the container, significant force can result in the area immediately below the hem due to the weight of the bag contents and the pulling action by the consumer, which can cause the plastic film to puncture or fail in this region of the bag—especially when the contents of the bag are particularly heavy.

Another aspect of prior art drawstring bags that may be subject to improvement is the tendency for the hems of drawstring bags to detach if there are even minor manufacturing defects. In particular, if the pressure or heat used to create the hem seal across the width of the drawstring trash bag is too great, the integrity of the drawstring trash bag may be endangered due to crystallization of the polymeric film along the hem seal. In these cases, when the drawstring trash bag is filled with trash or debris, the hem seal may fail causing the entire length of the hem, and the drawstring contained within the hem, to "zipper" or detach from the rest of the bag. The present invention may provide additional advantages by providing alternatives to traditional hem seals thereby overcoming the tendency of drawstring trash bags to fail in this manner.

In light of the foregoing, it would be desirable to provide a means for reinforcing the drawstring trash bag in the area immediately adjacent/below the hem area of the trash bag. The present invention represents a novel solution to address this need.

SUMMARY OF THE INVENTION

In at least one embodiment of the present invention, a thermoplastic bag has a front panel and a back panel. The front panel and back panel are generally joined along a first side edge, a second side edge, and a bottom edge of the respective front panel and back panel. The front panel also has a distal edge. A first overlap area comprises at least two layers of polymeric film below the upper opening of the thermoplastic bag. Furthermore, the at least two layers of polymeric film of the first overlap area are generally sealed together.

In some embodiments of the present invention, the thermoplastic bag may have a first hem immediately above the first overlap area. Additionally, a drawstring may be disposed within the first hem. In some embodiments, a first hem seal may be formed between the first hem and the first overlap area with the first hem seal extending generally from the first side edge of the thermoplastic bag to the second side edge of the thermoplastic bag.

In some embodiments, a first lower seal is located proximate the distal edge of the front panel and extends generally from the first side edge of the thermoplastic bag to the second side edge of the thermoplastic bag. In some such embodiments, the first lower seal is generally continuous while in other embodiments the first lower seal is intermittent.

In certain embodiments, the first overlap area has a height defined by a distance from a lower boundary of the first hem to the distal edge of the front panel with the height of the first overlap area being at least 1 inch. Additionally, in certain embodiments, the height of the first overlap area is less than 12 inches while in certain preferred embodiments the height of the first overlap area is in the range of 1.5 inches to 8 inches.

In certain embodiments, the at least two layers of polymeric film of the first overlap area are generally sealed together by a first plurality of lower seals extending between a lower boundary of the first hem to the distal edge of the front panel. Furthermore, the first hem seal may be formed between the first hem and the first overlap area with the first hem seal extending generally from the first side edge of the thermoplastic bag to the second side edge of the thermoplastic bag. The first plurality of lower seals may comprise a plurality of angular seals, each of the plurality of angular seals extending generally downwardly from the lower boundary of the first hem to proximate the distal edge of the front panel. Alternatively, the plurality of lower seals may extend generally from the first side edge of the thermoplastic bag to the second side edge of the thermoplastic bag and from the lower boundary of the first hem to a point proximate the distal edge of the front panel. In certain embodiments, the plurality of lower seals may comprise angular seals extending across the height of the overlap area while in other embodiments the plurality of lower seals may comprise a plurality of alternating smaller sealed areas.

BRIEF DESCRIPTION OF THE RELATED DRAWINGS

A full and complete understanding of the present invention may be obtained by reference to the detailed description of the present invention and certain embodiments when viewed with reference to the accompanying drawings. The drawings can be briefly described as follows.

FIG. 1 provides a perspective view of a first embodiment of the present invention.

Figure 2:
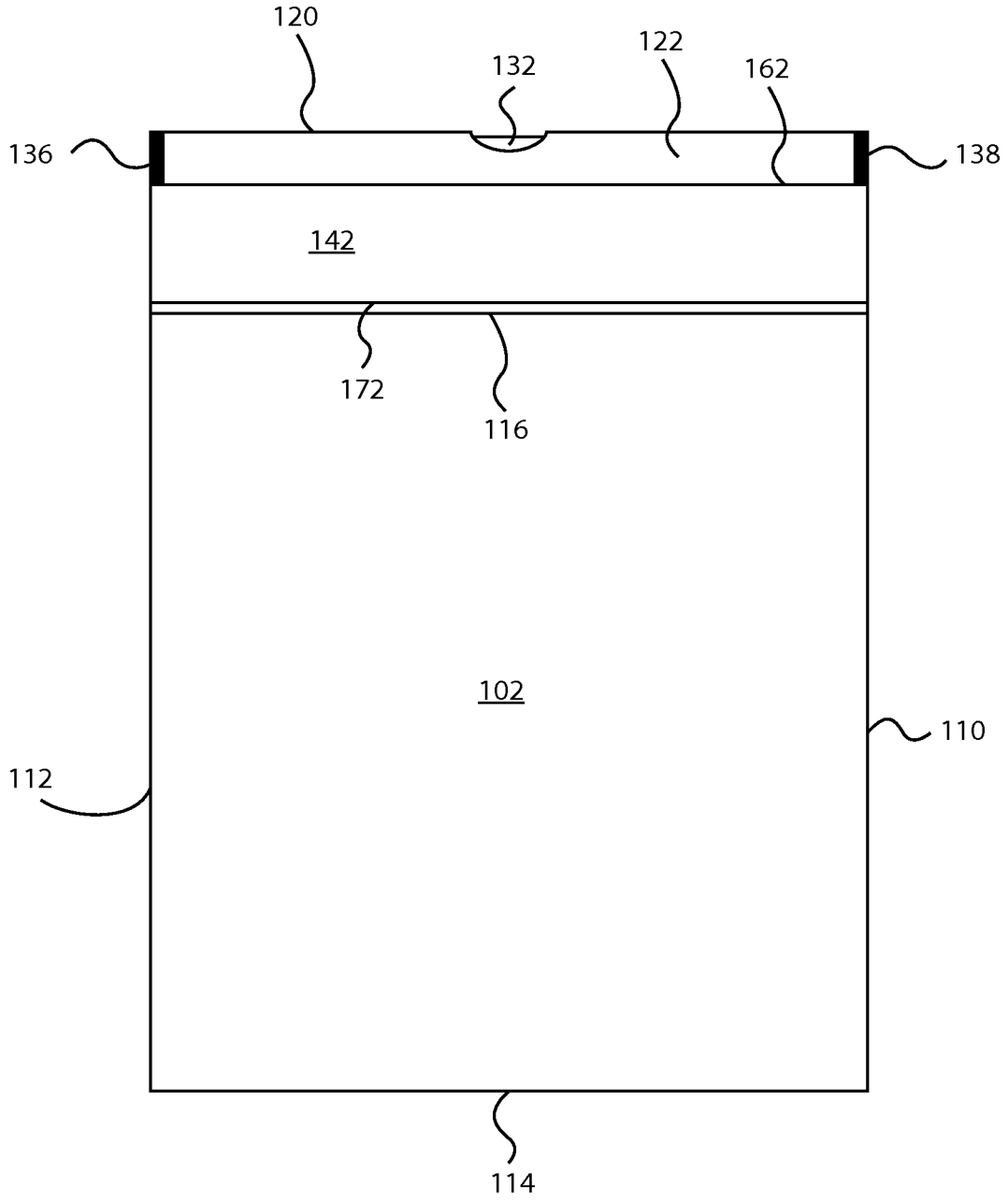

FIG. 2 provides an elevation view of the front panel according to a first embodiment of the present invention.

Figure 3:
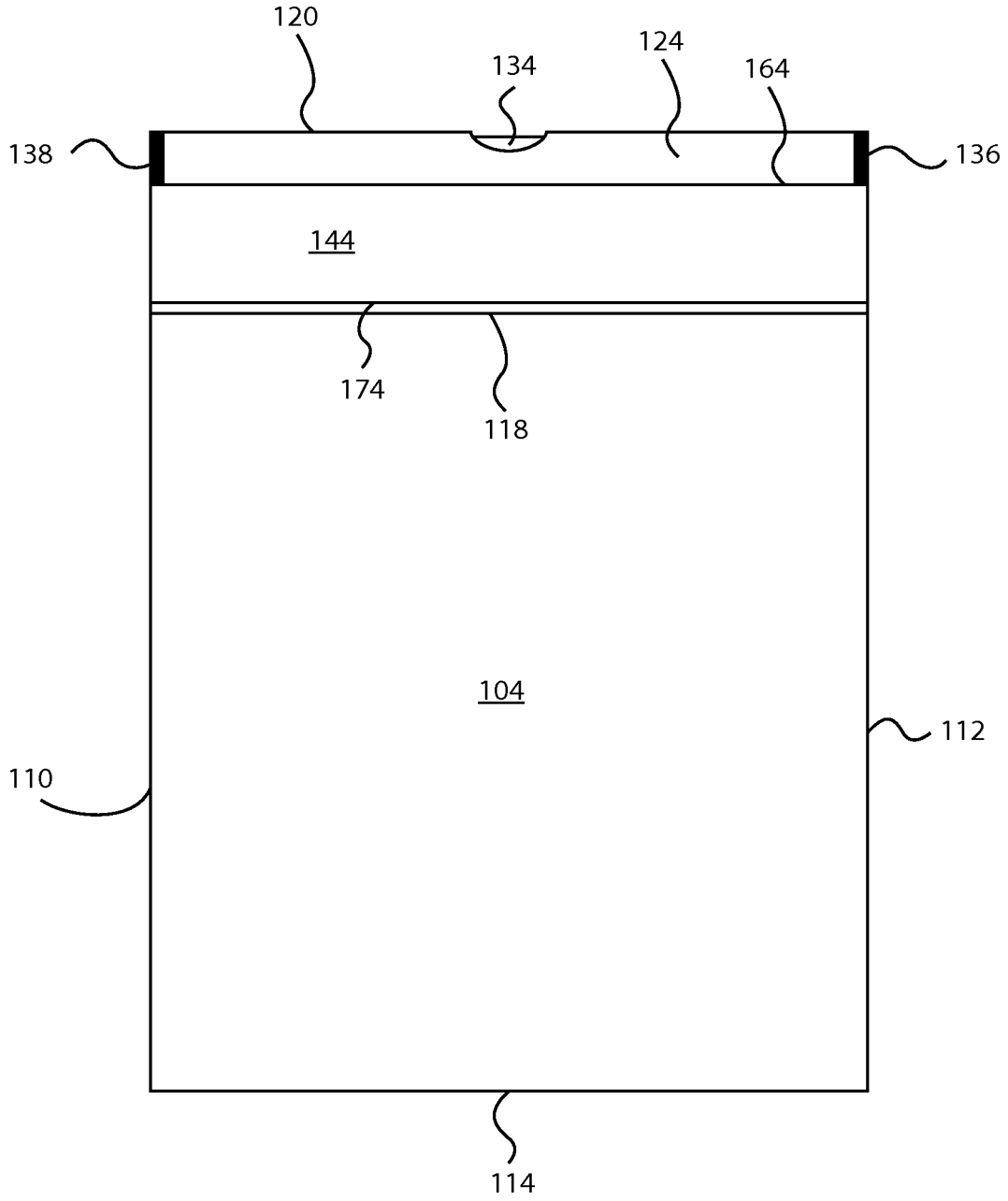

FIG. 3 provides an elevation view of the back panel according to a first embodiment of the present invention.

Figure 4:
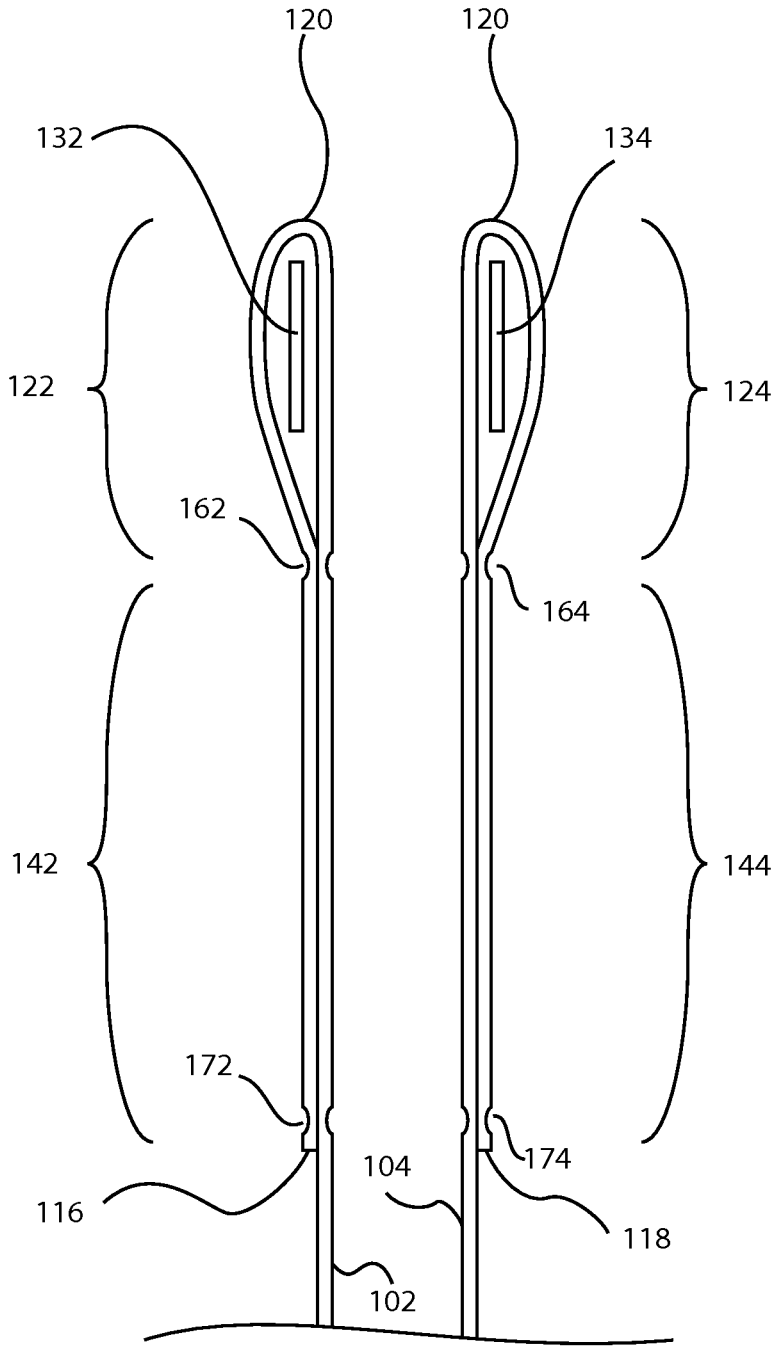

FIG. 4 provides a cross section perspective view of a first embodiment of the present invention.

Figure 5:
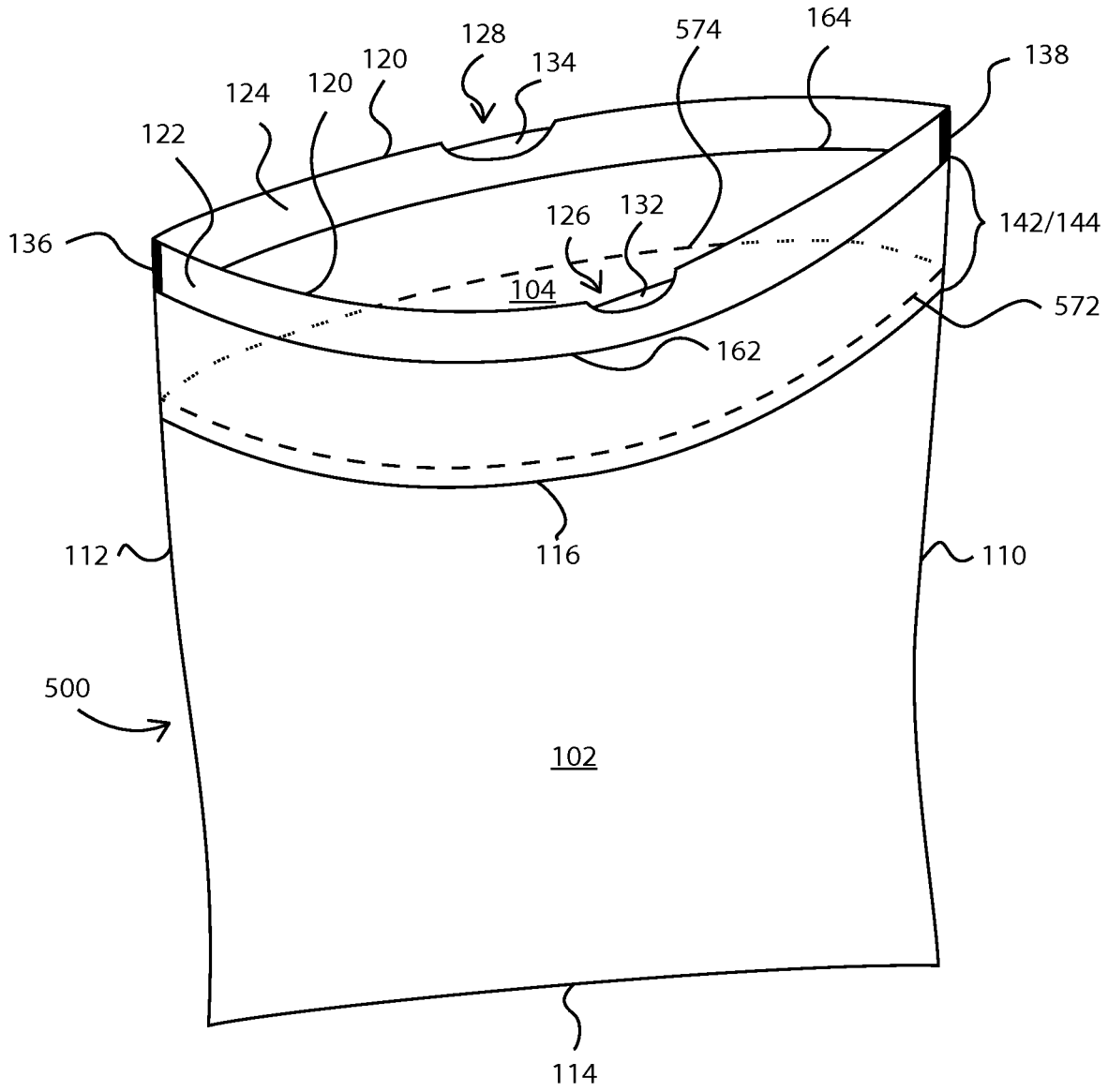

FIG. 5 provides a perspective view of a second embodiment of the present invention.

Figure 6:
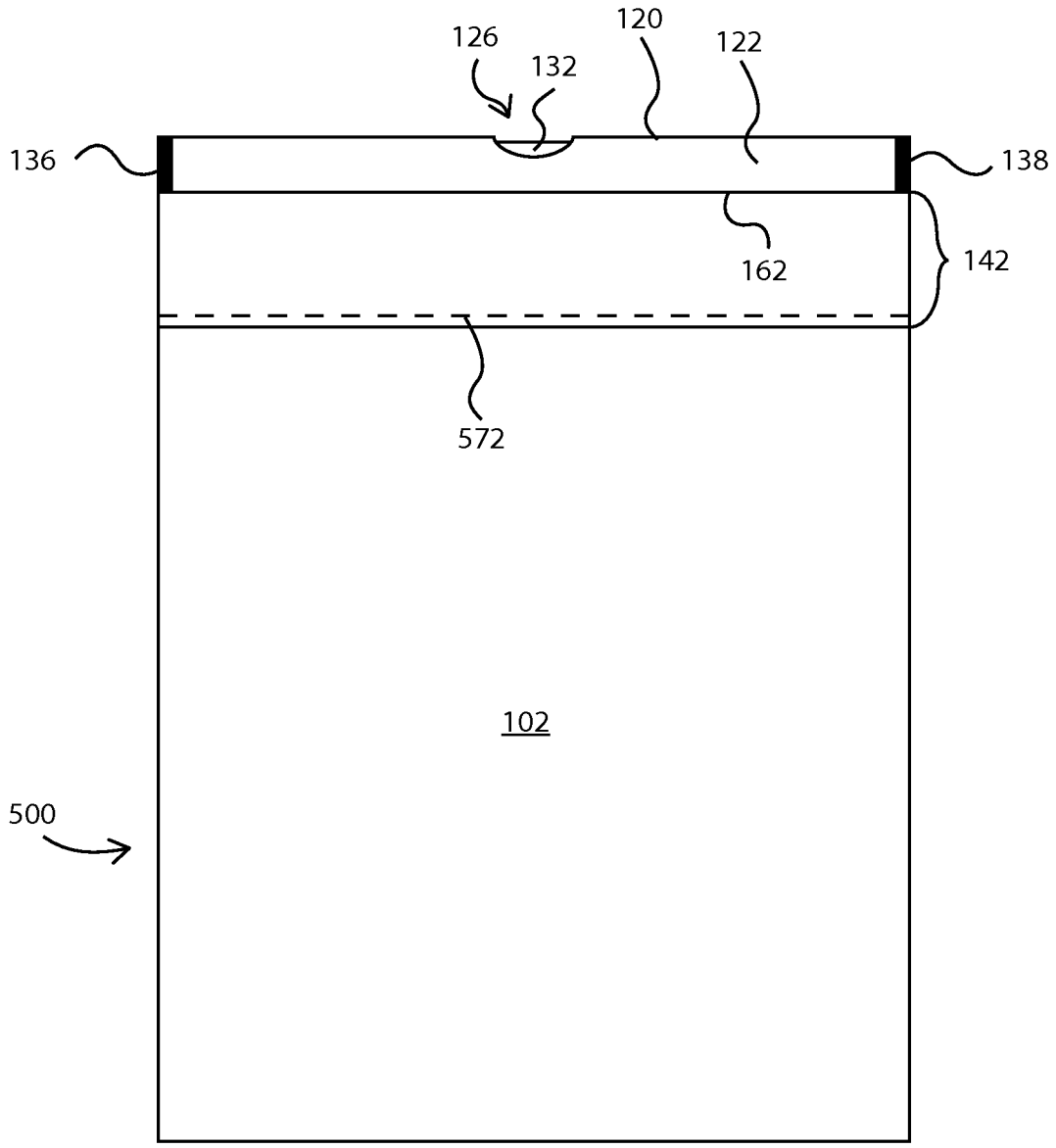

FIG. 6 provides an elevation view of a panel according to a second embodiment of the present invention.

Figure 7:
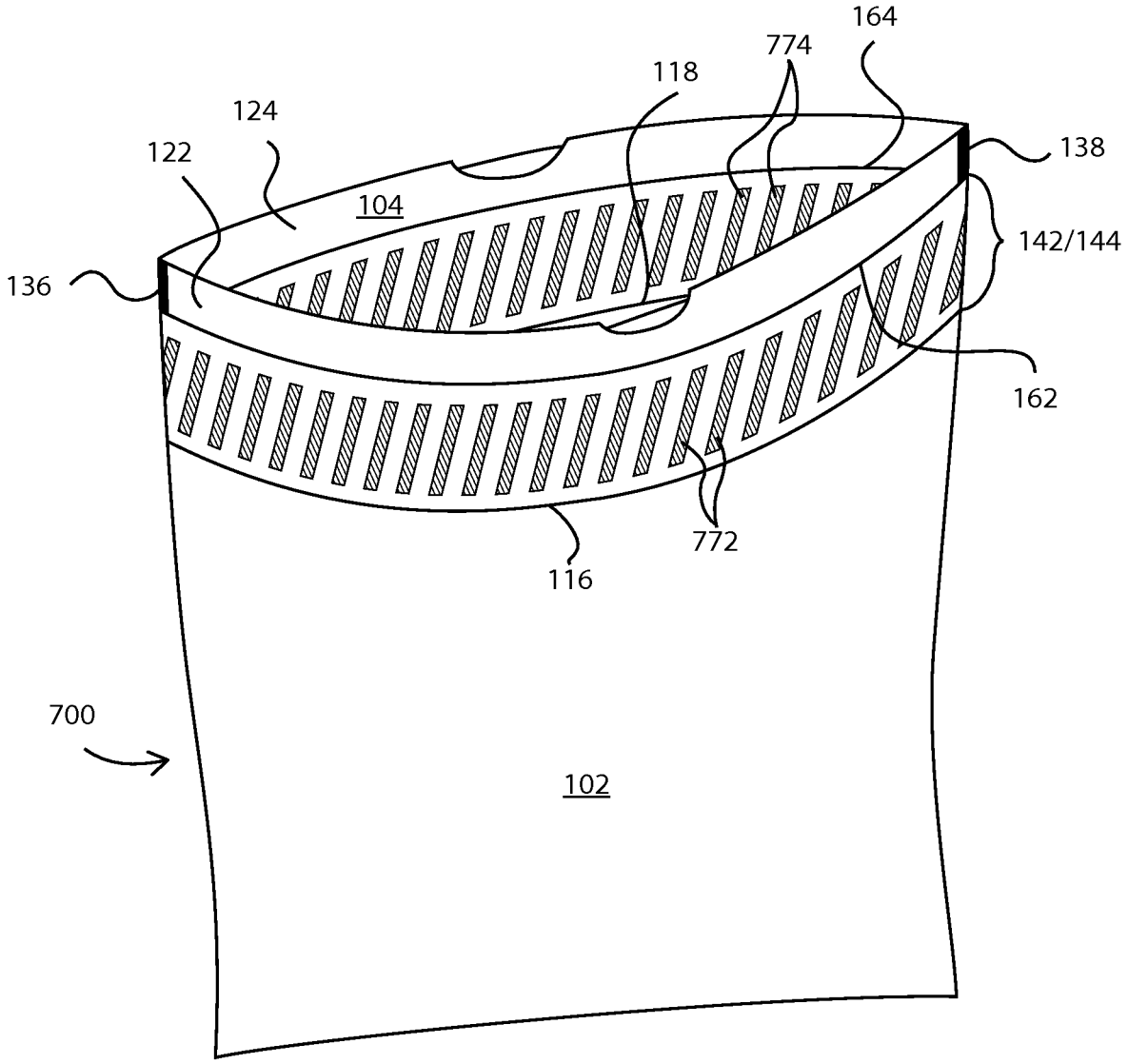

FIG. 7 provides a perspective view of a third embodiment of the present invention.

Figure 8:
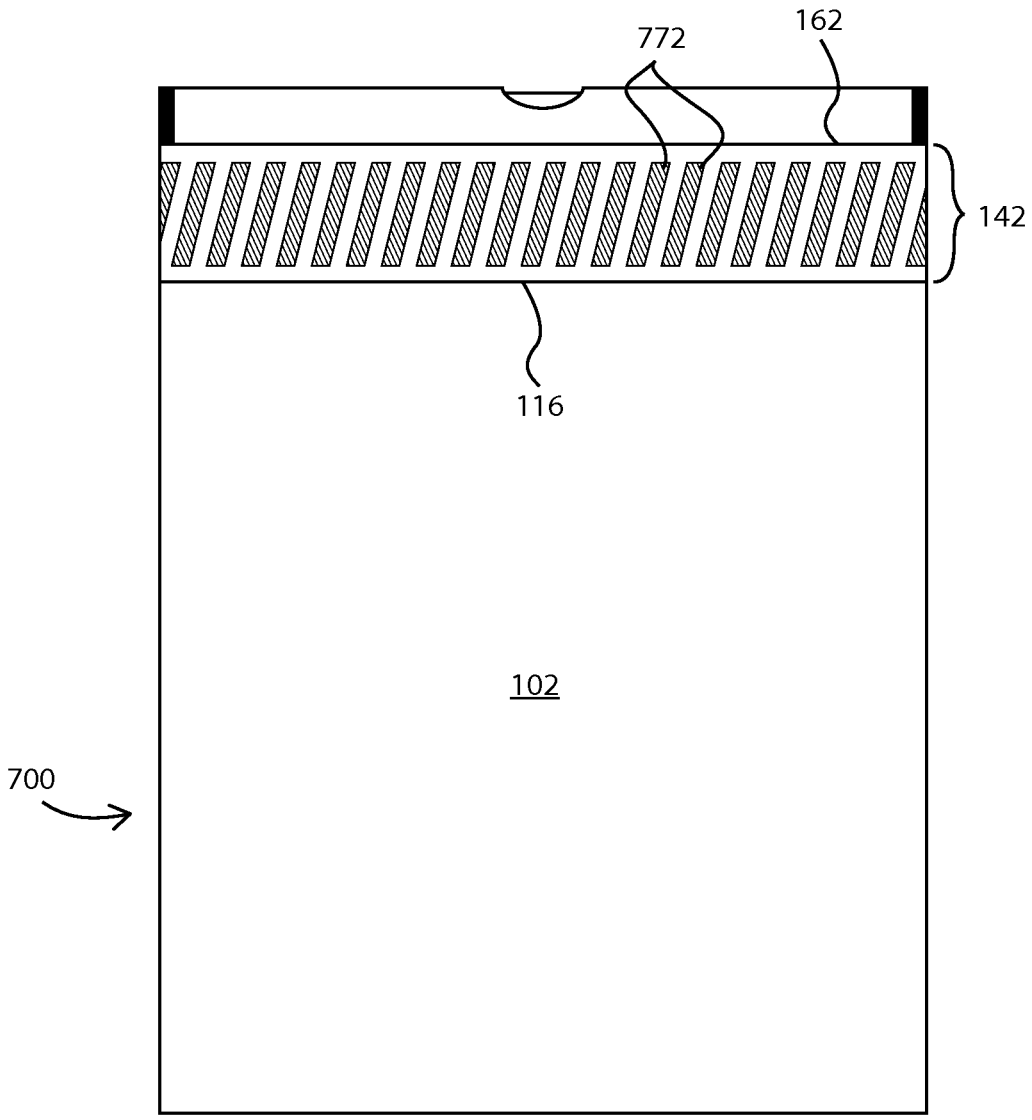

FIG. 8 provides an elevation view of a panel according to a third embodiment of the present invention.

Figure 9:
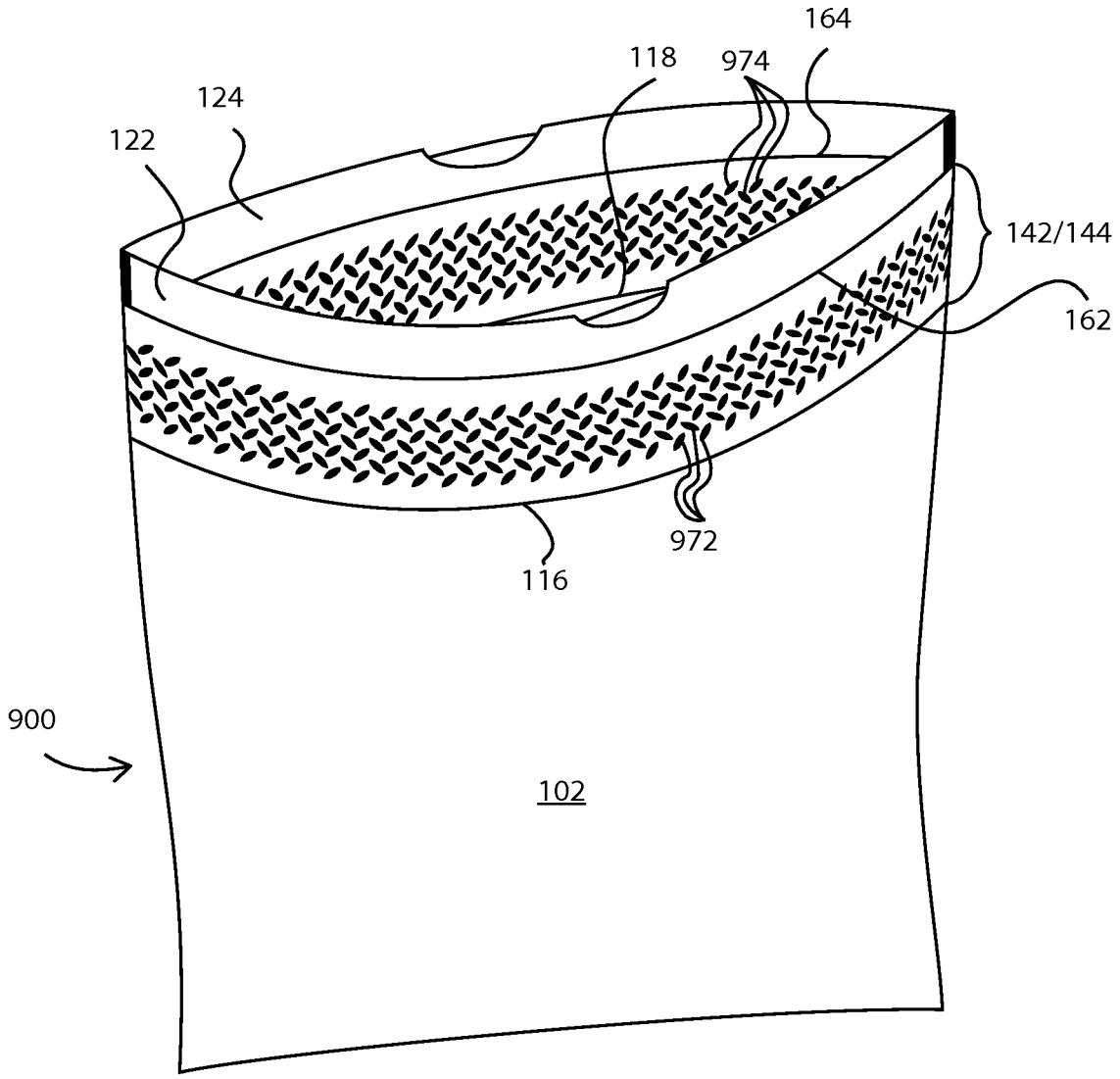

FIG. 9 provides a perspective view of a fourth embodiment of the present invention.

Figure 10:
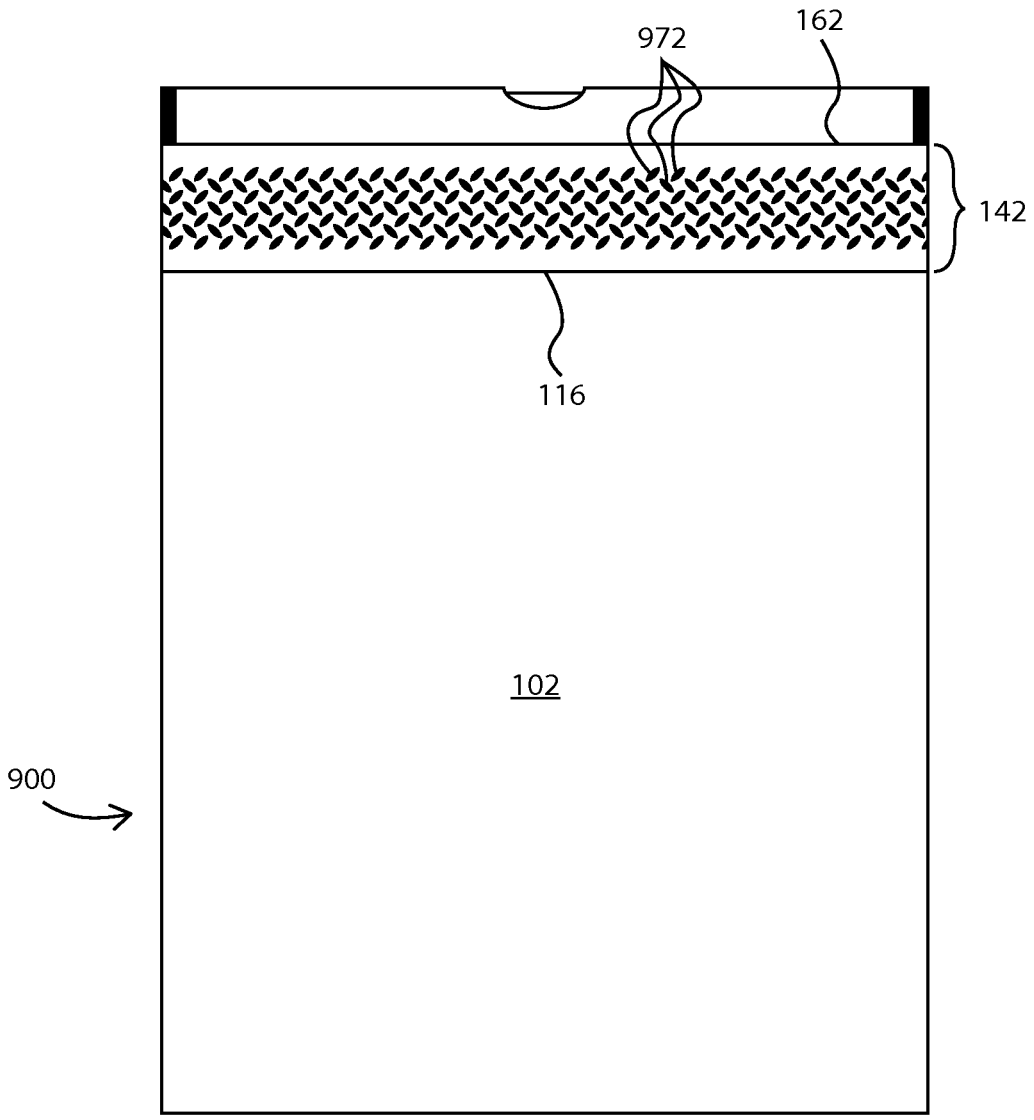

FIG. 10 provides an elevation view of a panel according to a fourth embodiment of the present invention.

Figure 11:
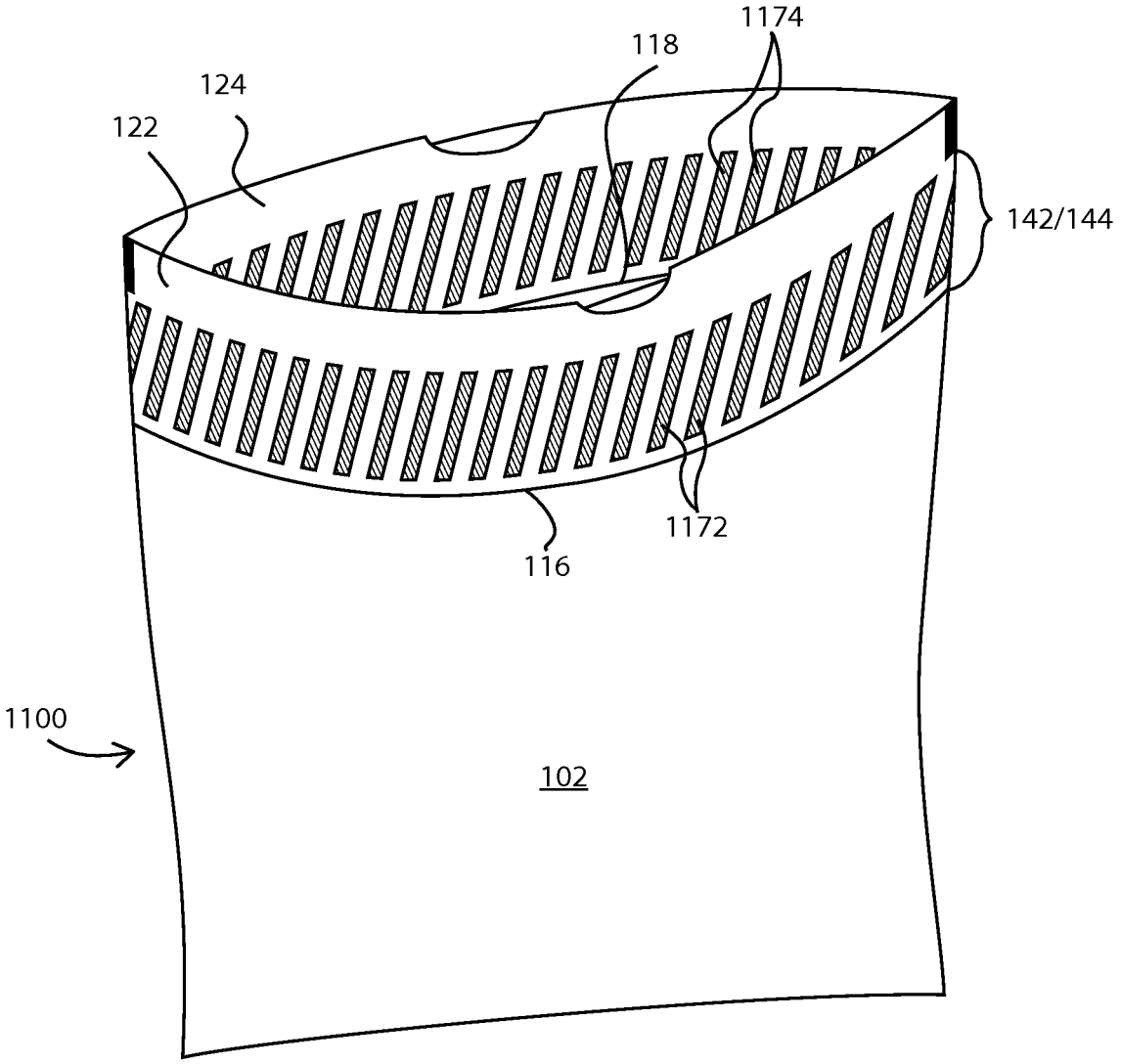

FIG. 11 provides a perspective view of a fifth embodiment of the present invention.

Figure 12:
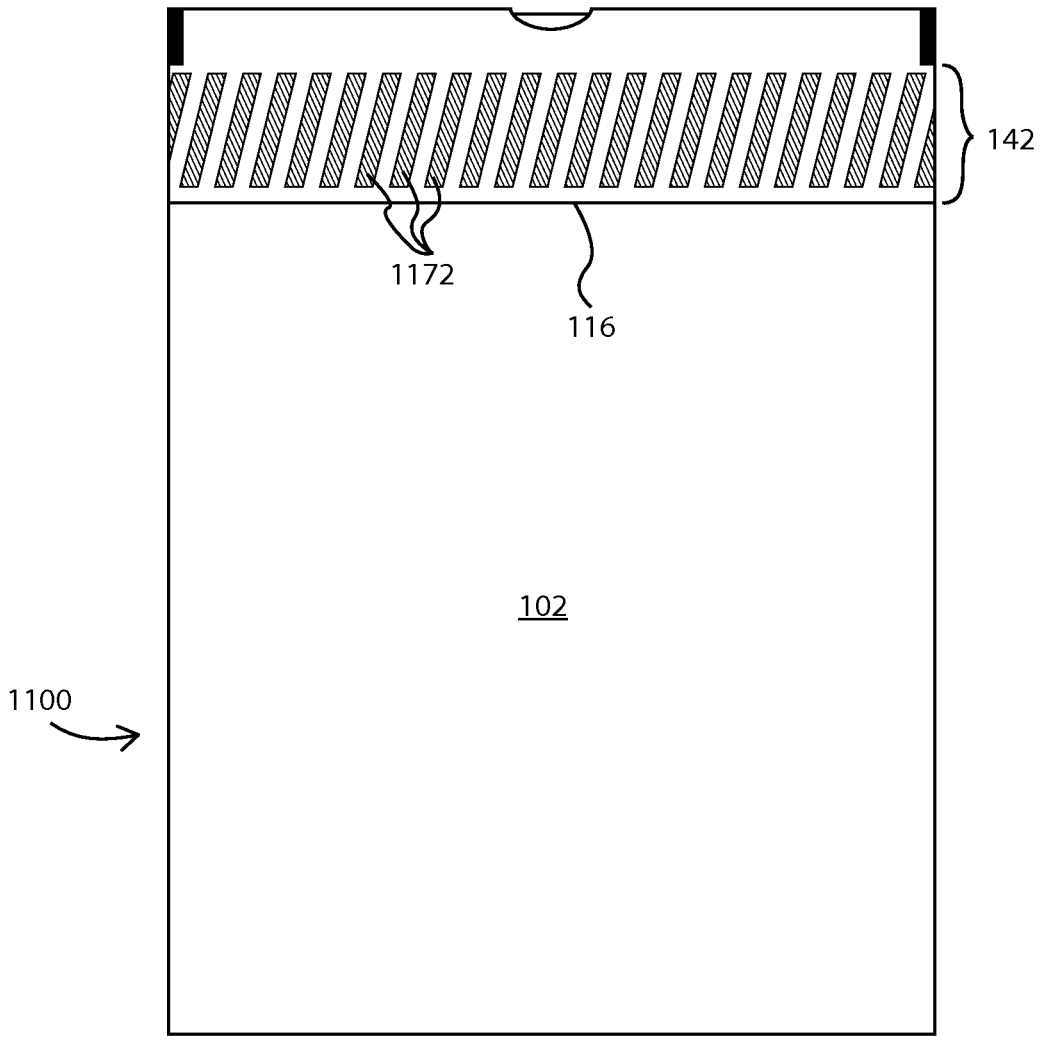

FIG. 12 provides an elevation view of a panel according to a fifth embodiment of the present invention.

Figure 13:
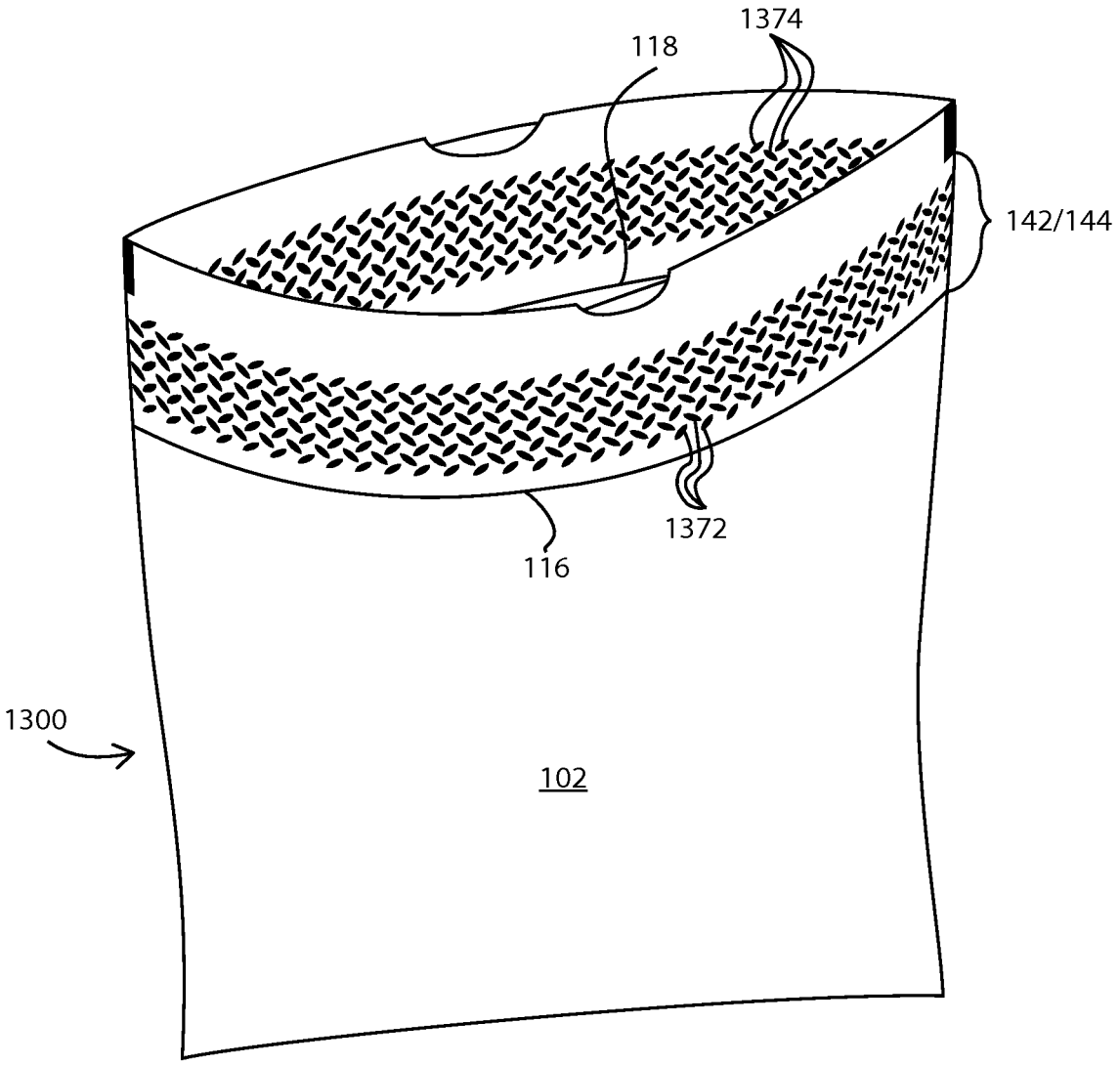

FIG. 13 provides a perspective view of a sixth embodiment of the present invention.

Figure 14:
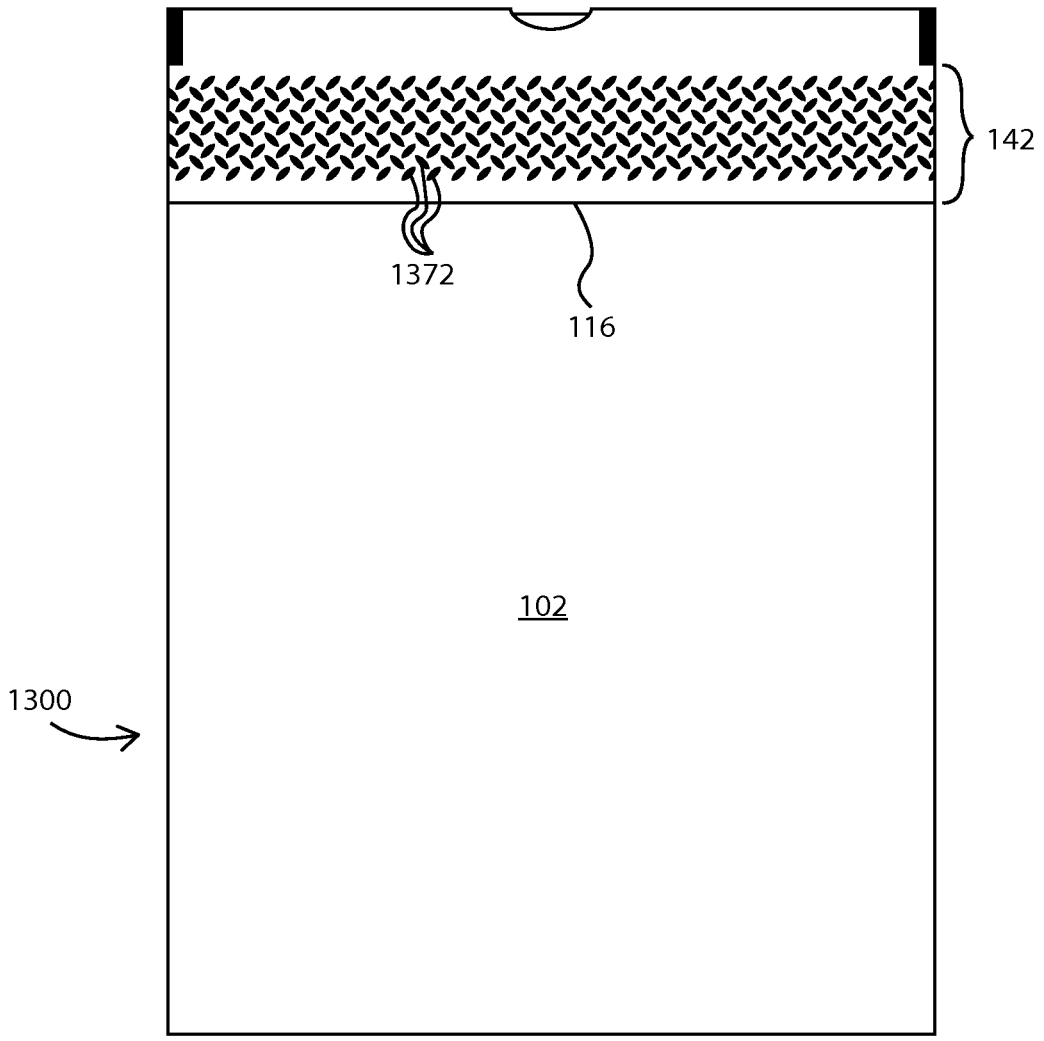

FIG. 14 provides an elevation view of a panel according to a sixth embodiment of the present invention.

Figure 15A:
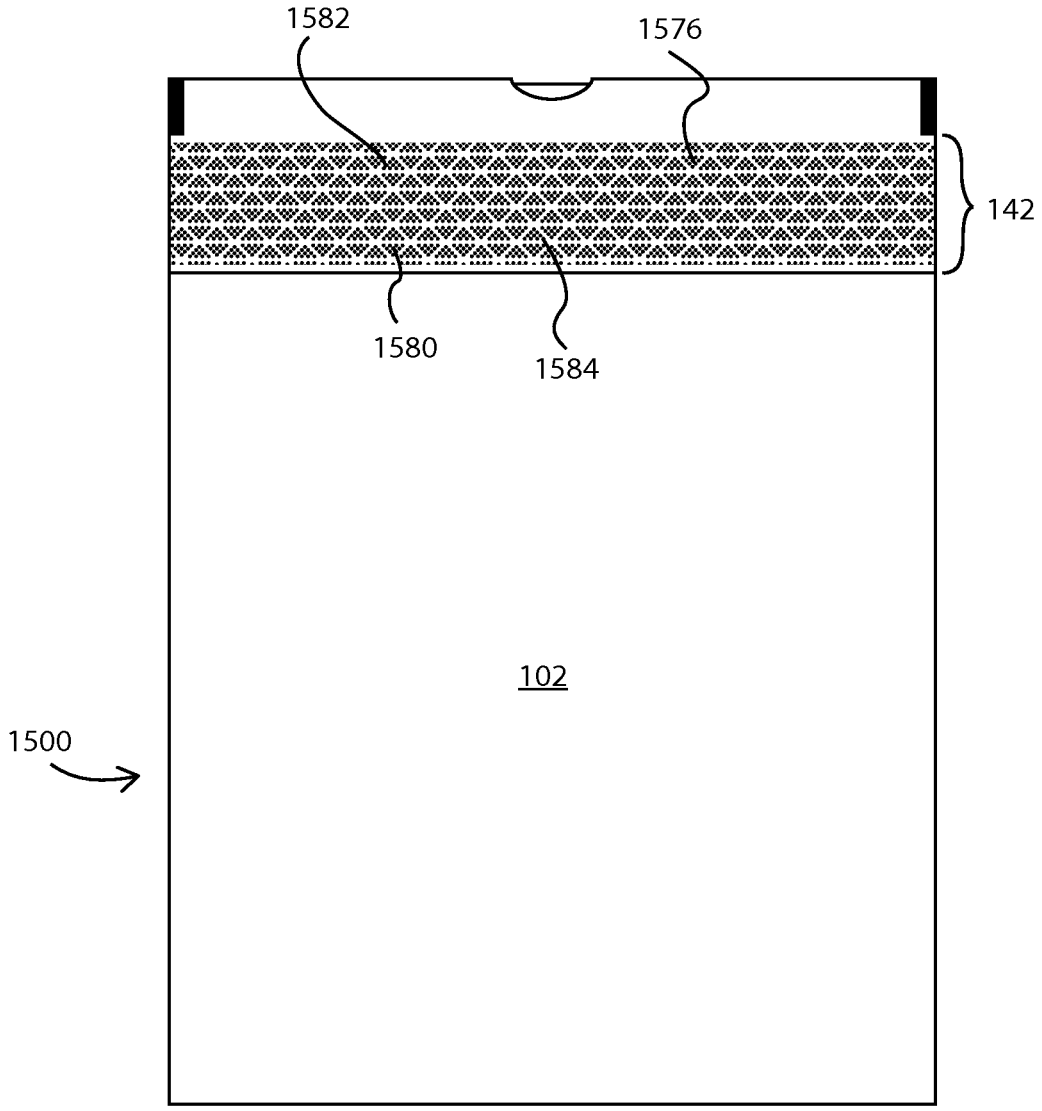

FIG. 15A provides an elevation view of a seventh embodiment of the present invention.

Figure 15B:
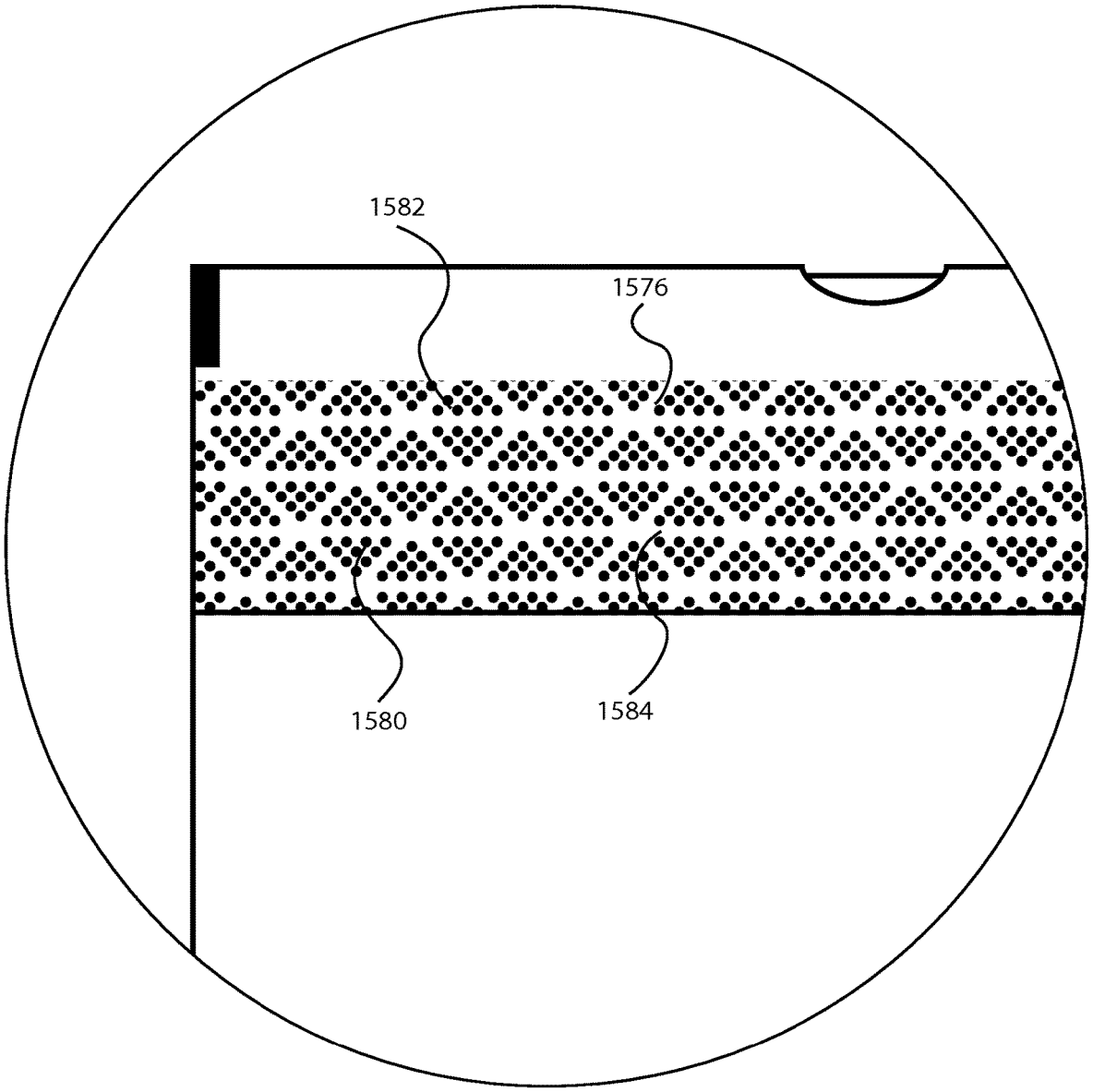

FIG. 15B provides an enlarged elevation view of a portion of a seventh embodiment of the present invention.

Figure 16:
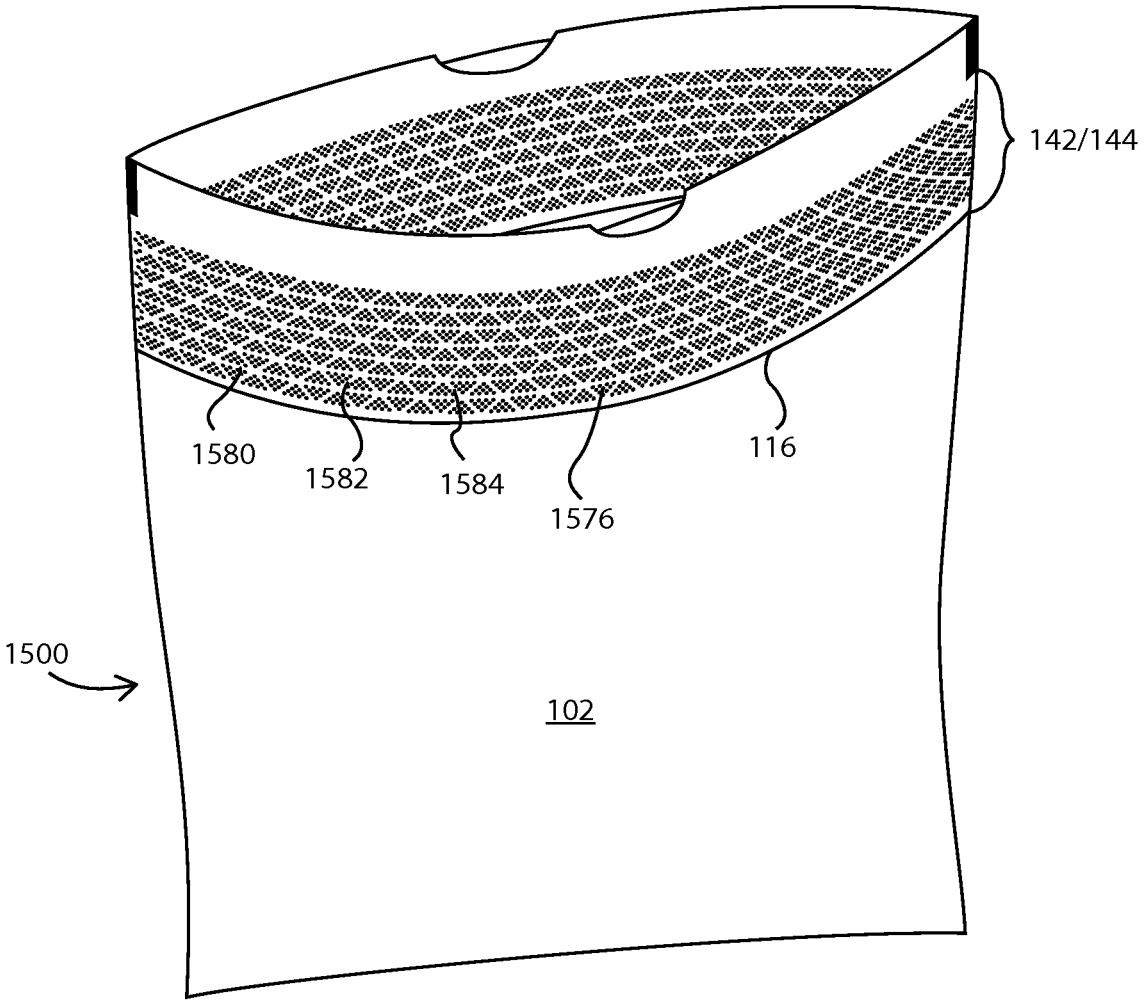

FIG. 16 provides a perspective view of a panel according to a seventh embodiment of the present invention.

Figure 17:
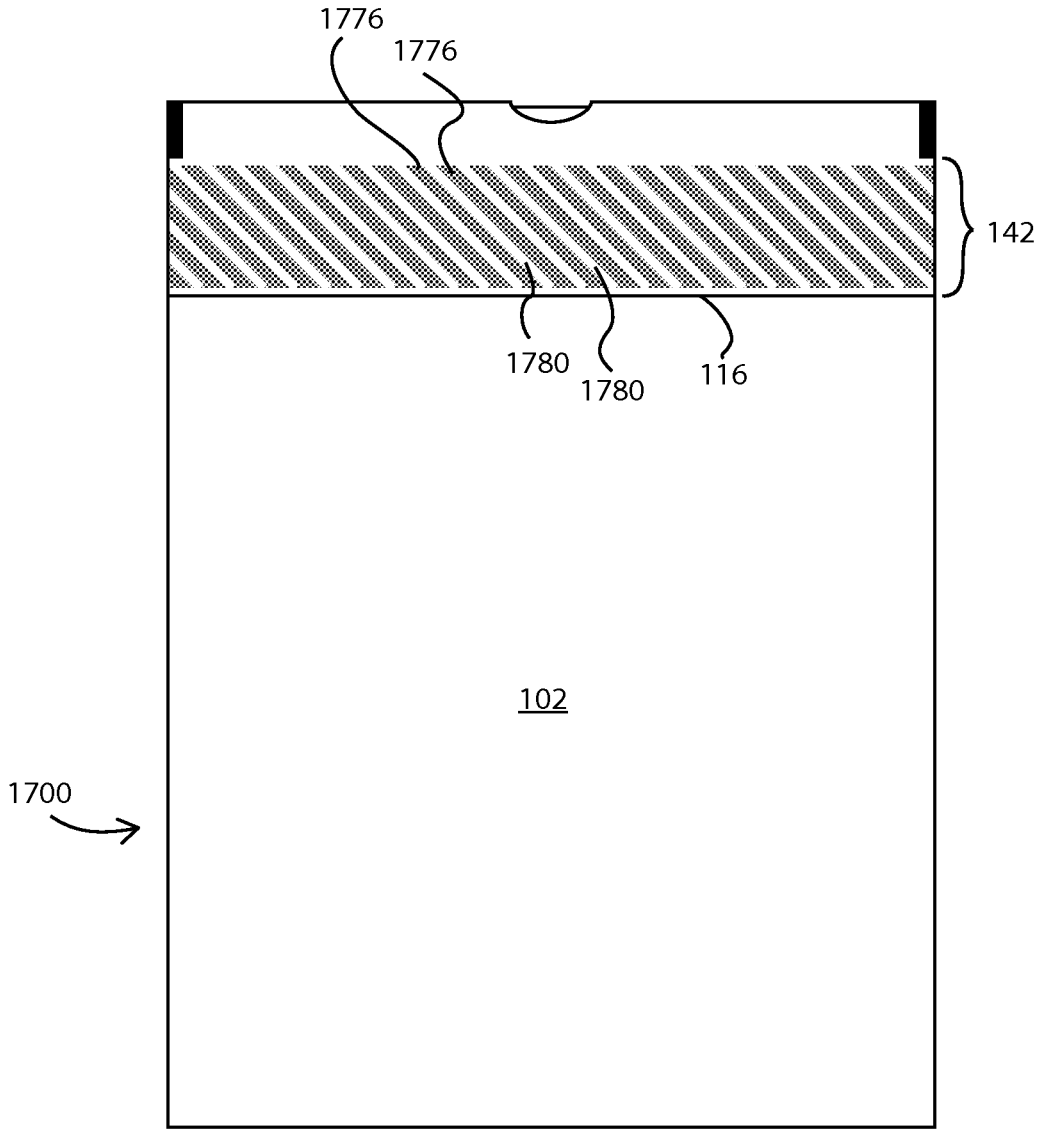

FIG. 17 provides an elevation view of an eighth embodiment of the present invention.

Figure 18:
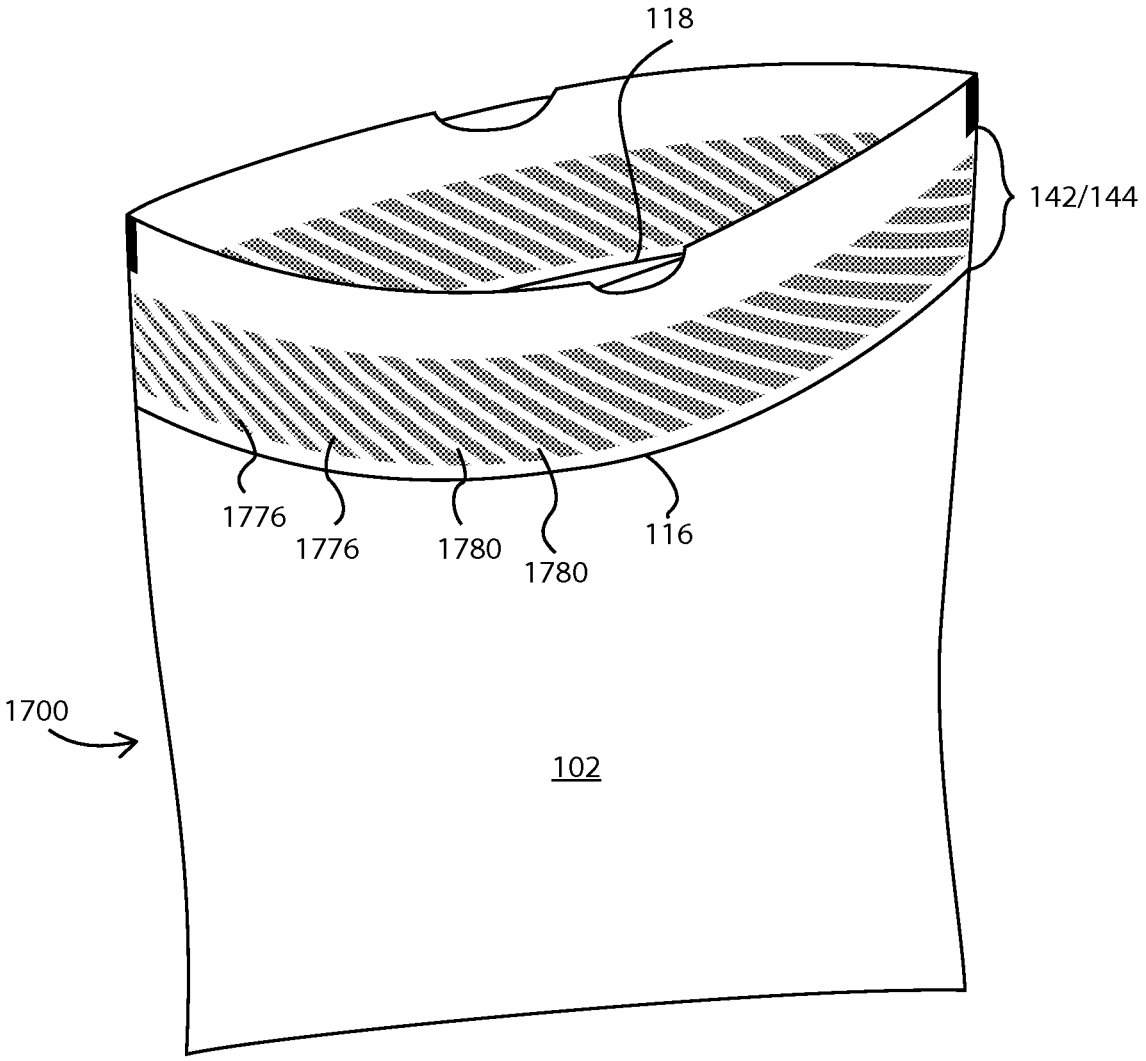

FIG. 18 provides a perspective view of a panel according to an eighth embodiment of the present invention.

Figure 19:
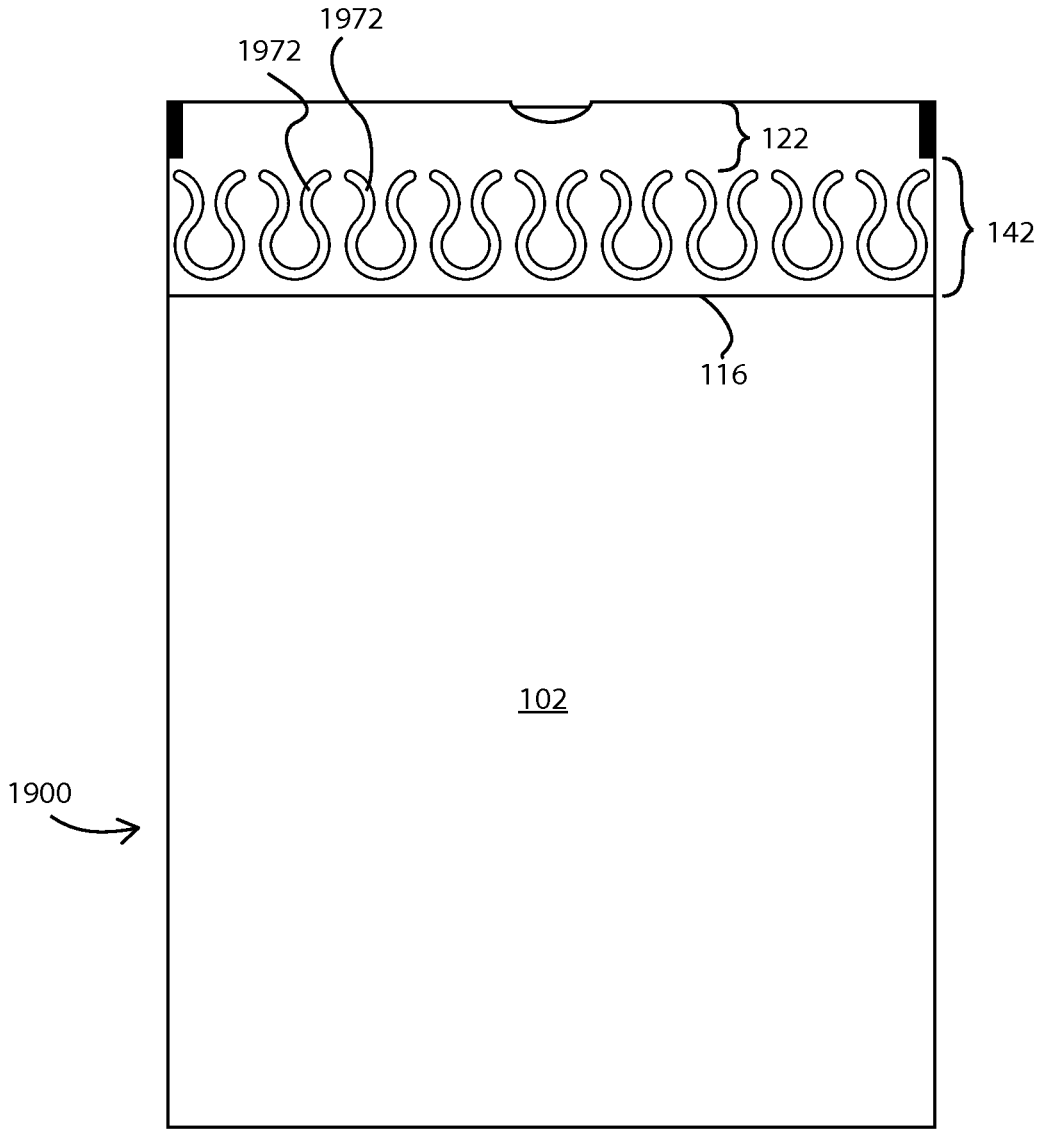

FIG. 19 provides an elevation view of a ninth embodiment of the present invention.

Figure 20:
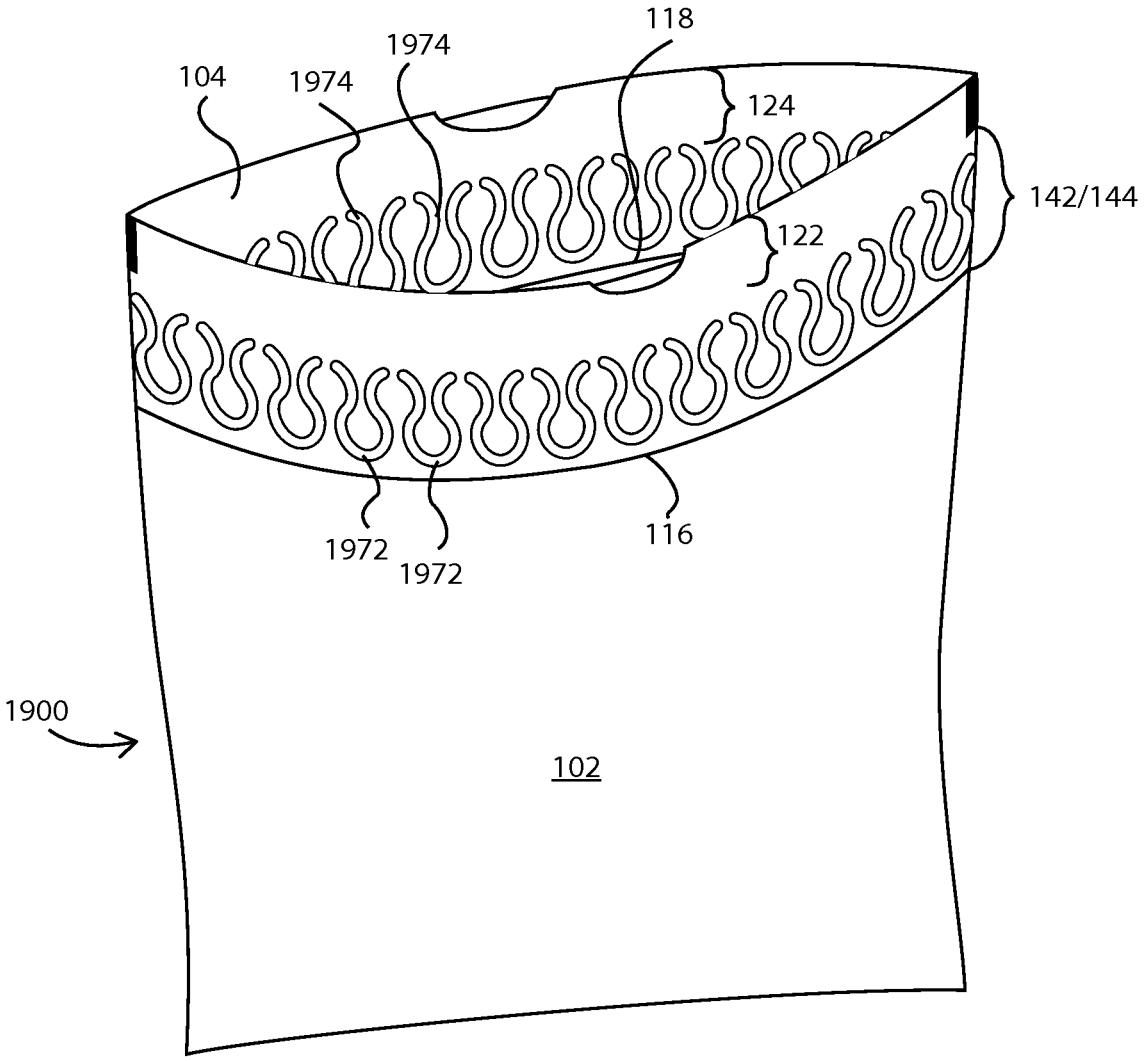

FIG. 20 provides a perspective view of a panel according to a ninth embodiment of the present invention.

DETAILED DESCRIPTION OF THE INVENTION

The present disclosure illustrates several embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms are not intended to conclusively limit the scope of protection.

FIG. 1 provides a perspective view of a first embodiment of the present invention while FIG. 2 and FIG. 3 show a front and rear elevation of the same embodiment. Looking collectively at FIGS. 1-3, a drawstring trash bag 100 according to one embodiment is comprised of a front panel 102 and a back panel 104, the front panel 102 and back panel 104 being substantially rectangular in shape and joined along a first side edge 110, a second side edge 112, and a bottom edge 114 to provide the body of the bag. The front panel 102 and back panel 104 may be formed from a single piece of polymeric film which is folded to define the bottom edge 114 and subsequently sealed along the first side edge 110 and second side edge 112. However, other manufacturing configurations may be utilized in conjunction with the present invention. In certain embodiments, the front panel 102 and the back panel 104 are formed by plastic films that are substantially uniform in thickness, subject to standard manufacturing tolerances and variations, with an average thickness of between 0.4 mils and 4 mils for each panel 102, 104. Moreover, in some embodiments, the average thickness of each of the respective panels 102, 104 is between 0.6 mil and 1.0 mil. Moreover, in certain preferred embodiments, the average thickness of each of the respective panels 102, 104 is between 0.75 mils and 1.0 mils.

In certain embodiments of the present invention, including the embodiment depicted in FIG. 1, the front panel 102 and back panel 104 of the drawstring trash bag 100 are comprised of a polymer blend, the polymer blend generally having linear low density polyethylene (LLDPE) as the primary component, but other polymers may be utilized including, but not limited to, other polyethylenes such as high density polyethylene (HDPE) or low density polyethylene (LDPE). Typically, the primary component of the polymer blend, such as linear low density polyethylene (LLDPE), will comprise at least 75% of the polymer blend. The remaining portion of the polymer blend may include additives including, but not limited to, coloring additives, anti-blocking agents, and/or odor control additives.

Looking briefly at FIG. 4, a cross-section view of one embodiment of the present invention, better illustrates certain aspects, features, and advantages of the present invention. In particular, an upper cross-section of a drawstring trash bag 100 is depicted although the thicknesses and dimensions are exaggerated to better illustrate the relation between the various parts of the particular embodiment. During manufacture of the drawstring trash bag, the distal edge 116 of the front panel 102, i.e. the edge of the folded-over portion of the front panel 102 results from the fold-over defining the first hem 122 in the front panel 102 and a first drawstring 132 is disposed within the first hem 122. Similarly, the distal edge 118 of the back panel 104 results from the fold-over defining the second hem 124 with a second drawstring 134 disposed in the second hem 124. The upper boundaries of the hems 122, 124 define the upper opening 120 of the drawstring trash bag 100.

The drawstrings 132, 134 may be comprised of traditional high-density polyethylene drawstrings or, in some embodiments, elastic or elastic-like polymeric components. The drawstrings 132, 134 are anchored to the front panel 102 and back panel 104 at the ends of the respective drawstrings 132, 134 near the first side edge 110 and second side edge 112. In particular, the drawstrings 132, 134 are commonly anchored using short seals 136, 138 as shown in FIGS. 1-3, the short seals 136, 138 fusing both drawstrings 132, 134 with both the front panel 102 and the back panel 104. Other than the anchor point, the drawstrings 132, 134 are generally loose within the hems 122, 124 enabling the drawstrings 122, 124 to be accessed and pulled through the respective drawstring cutouts 126, 128 centrally located between the first side edge 110 and second side edge 112. Consequently, when the drawstrings 132, 134 are pulled through the drawstring cutouts 126, 128 of the drawstring trash bag 100, the respective upper corners of the drawstring trash bag 100 are pulled together to facilitate closure of the bag.

Now looking at FIGS. 1-4, according to the depicted embodiment of the present invention the distal edges 116, 118 of the respective front and back panels 102, 104 are located a distance below the respective hems 122, 124. Thus, the front panel 102 has an overlap area 142 that extends from the lower boundary of the first hem 122 to the distal edge 116 of the front panel 102. In the same manner, the back panel 104 has an overlap area 144 that extends from the lower boundary of the second hem 124 to the distal edge 118 of the back panel 104. Thus, for the front panel 102, the overlap area 142 comprises two layers of polymeric film, and the hem overlap area 144 of the back panel 104 also comprises two layers of polymeric film according to the depicted embodiment. The length of the first overlap area 142 and the second overlap area 144 can be selected to be any length including a distance ending only slightly below the bottom boundaries of the respective hems 122, 124 or a distance that extends nearly to the bottom of the bag. However, in certain embodiments, it is desirable to provide a first overlap area 142 or second overlap area 144 of between 1 inch and 12 inches with a preferred range of 1.5 inches to 8 inches.

The overlap areas 142, 144 as shown in the depicted embodiments provide important benefits during use of the drawstring trash bag 100. The primary benefit offered by the overlap areas 142, 144 is reinforcing the drawstring trash bag 100 in the areas immediately below the hems 122, 124. As best illustrated by FIG. 4, it can be seen that the thickness of the polymeric film is essentially doubled in the overlap areas 142, 144 compared to the remaining area of the front panel 102 and back panel 104 below the overlap areas 142, 144. The thicker overlap area 142, 144 is therefore expected to be stronger than the remainder of the bag. Thus, in the event that a consumer is carrying the bag or gripping the bag in one or both of the overlap areas 142, 144, it is less likely that the drawstring trash bag 100 will puncture or tear in that particular area. By reducing the likelihood that the drawstring trash bag 100 will fail when a consumer grabs the drawstring trash bag 100 in the overlap areas 142, 144, the drawstring trash bag 100 is more useful—especially when it contains heavier items or debris.

The depicted embodiment of FIGS. 1-4 is illustrated as having hem seals 162, 164 extending the width of the drawstring trash bag 100. Additionally, lower seals 172, 174 are provided in the respective panels 102, 104 proximate to the respective distal edges 116, 118. By providing hem seals 162, 164 near the top of the overlap areas 142, 144 and lower seals 172, 174 near the bottom of the overlap areas 142, 144, the two layers of plastic film comprising each overlap area 142, 144 are kept in close proximity, providing effectively a two-ply polymeric film of double thickness in the region of the overlap areas 142, 144. For example, in the case of a front panel 102 and back panel 104 each having a nominal thickness of 0.7 mil, the overlap areas 142, 144 provide a thickness of roughly 1.4 mils, thereby providing a much stronger area for a consumer to grab, pull, and lift the trash bag.

FIG. 5 and FIG. 6 depict a second embodiment of the present invention. Specifically, FIG. 5 shows a perspective view of a drawstring trash bag 500 according to the disclosed embodiment with FIG. 6 illustrating an elevation view of the front panel 102. Although not expressly shown, a person of ordinary skill in the art would understand that the back panel 104 of the depicted embodiment could be constructed in the same manner as the depicted front panel 102 or in any other manner consistent with the present disclosure.

Looking at FIG. 5 and FIG. 6 together, the depicted embodiment of a drawstring trash bag 500 is very similar to the embodiment depicted earlier in FIGS. 1-3 with the exception that instead of continuous lower seals extending across the width of the bag shown in the prior embodiment, in the depicted embodiment the lower seals 572, 574 are intermittent across the width of the drawstring trash bag 500. The intermittent configuration of the seals facilitates the release of air that could potentially be trapped within the overlap areas 142, 144 during both manufacture and use of the drawstring trash bag 500.

FIG. 7 and FIG. 8 depict a third embodiment of the present invention. Specifically, FIG. 7 shows a perspective view of a drawstring trash bag 700 according to the disclosed embodiment with FIG. 8 illustrating an elevation view of the front panel 102. Although not expressly shown, a person of ordinary skill in the art would understand that the back panel 104 of the depicted embodiment is constructed to be a mirror image of the front panel 102, but could also be constructed in any other manner consistent with the present disclosure.

Looking at FIG. 7 and FIG. 8 together, the drawstring trash bag 700 lacks the transverse lower seals 172, 174 of previous embodiments and instead has lower seals 772, 774 comprised of a series of angular seals extending substantially across the entire height of the overlap areas 142, 144, extending generally from the area below the hem seals 162, 164 down to a point just above the distal edges 116, 118 of the respective front panel 102 and back panel 104. As with the hem seals 162, 164 and the lower seals 172, 174 of prior embodiments, the angular lower seals 772 join the overlap area 142 of the front panel 102 to the body portion of the same front panel 102. Similarly, angular lower seals 774 bond the overlap area 144 of the back panel 104 to the body portion of the same back panel 104. This configuration of the angular seals comprising the lower seals 772, 774 also facilitates the escape of any air trapped within the overlap areas 142, 144 during manufacture or use of the drawstring trash bag 700.

A fourth embodiment of the present invention is shown in FIG. 9 and FIG. 10, which discloses a drawstring trash bag 900 which again lacks the lower seals 172, 174 of previous embodiments and instead has lower seals 972, 974 comprised of a plurality of alternating smaller sealed areas, the individual sealed areas of lower seals 972 of the front panel 102 bonding the overlap area 142 of the front panel 102 to the body portion of the same front panel 102. Similarly the individual sealed areas of the lower seals 974 bond the overlap area 144 of the back panel 104 to the body portion of the same back panel 104.

A fifth embodiment of the present invention is shown in FIG. 11 and FIG. 12, which is similar to the previously disclosed third embodiment. In this fifth disclosed embodiment, the drawstring trash bag 1100 has lower seals 1172, 1174 comprised of a series of sealed angular seals extending substantially across the height of the overlap areas 142, 144 down to a point just above the distal edges 116, 118 of the respective front panel 102 and back panel 104. However, unlike previous embodiments, in this embodiment, traditional hem seals 162, 164 are omitted with the lower seals 1172, 1174 defining the bottom boundaries of the hems 122, 124.

A sixth embodiment of the present invention is shown in FIG. 13 and FIG. 14, which is similar in some aspects to the previously disclosed fourth embodiment. In this sixth disclosed embodiment, the drawstring trash bag 1300 has lower seals 1372, 1374 comprised of a plurality of alternating smaller sealed areas, the individual sealed areas of lower seals 1372 of the front panel 102 bonding the overlap area 142 of the front panel 102 to the body portion of the same front panel 102. Similarly the individual sealed areas of the lower seals 1374 bond the overlap area 144 of the back panel 104 to the body portion of the same back panel 104. Lower seals 1372, 1374 extend generally across the entire height of the overlap areas 142, 144 to a point just above the distal edges 116, 118 of the respective front panel 102 and back panel 104. However, in the same manner as disclosed with respect to the fifth embodiment, traditional hem seals 162, 164 are omitted with certain lower seals 1372, 1374 defining the bottom boundaries of the hems 122, 124.

A seventh embodiment of the present invention is shown in FIG. 15A, FIG. 15B and FIG. 16. In this seventh disclosed embodiment, the drawstring trash bag 1500 has a plurality of triangular embossed areas 1576, each triangular embossed area 1576 comprising a plurality of embosses, preferably circular embosses. The triangular embossed areas 1576 extend substantially across the height of the overlap areas 142, 144 down to a point just above the distal edges 116, 118 of the respective front panel 102 and back panel 104. In this particular embodiment, the triangular embossed areas 1576 are separated from one another by sets of sealed bands 1580, 1582, 1584. Each set of sealed bands 1580, 1582, 1584 comprises a set of substantially parallel sealed areas extending across the overlap areas 142, 144. The first set of sealed bands 1580 may extend in a direction generally parallel with the upper opening 120 and bottom of the bag. The second and third set of sealed bands 1582, 1584 are offset from one another, and the first set 1580, by approximately 60 degrees. Each of the set of sealed bands 1580, 1582, 1584 seals the overlap areas 142, 144 to the respective panels 102, 104.

An eighth embodiment of the present invention is shown in FIG. 17 and FIG. 18. In this eighth disclosed embodiment, the drawstring trash bag 1700 has a plurality of parallelogram embossed areas 1776, each parallelogram embossed area 1776 comprising a plurality of embosses, preferably circular embosses. The parallelogram embossed areas 1776 extend substantially across the height of the overlap areas 142, 144 down to a point just above the distal edges 116, 118 of the respective front panel 102 and back panel 104. In this particular embodiment, the parallelogram embossed areas 1776 are separated by sealed bands 1780. The sealed bands 1780 are substantially parallel to each other and extend across the overlap areas 142, 144, preferably at an angle other than parallel to one of the sides 110, 112, including the upper opening 120 or bottom 114, of the drawstring trash bag 1700.

A ninth embodiment of the present invention is shown in FIG. 19 and FIG. 20. In this ninth disclosed embodiment, the drawstring trash bag 1900 has lower seals 1972, 1974 comprised of a series of curvilinear seals extending substantially across the height of the overlap areas 142, 144 down to a point just above the distal edges 116, 118 of the respective front panel 102 and back panel 104. In this particular embodiment, the curvilinear seals 1972, 1974 are generally U-shaped with a narrowing along the middle of the U-shape. More importantly, the curvilinear lower seals 1972, 1974 are advantageous because the curvilinear edges of the respective seals 1972, 1974 reduce the likelihood of tears propagating. Like other previous embodiments, traditional hem seals are omitted with the lower seals 1972, 1974 defining the bottom boundaries of the hems 122, 124.

As previously noted, the specific embodiments depicted herein are not intended to limit the scope of the present invention. Indeed, it is contemplated that any number of different embodiments may be utilized without diverging from the spirit of the invention. Therefore, the appended claims are intended to more fully encompass the full scope of the present invention.

What is claimed is:

1. A thermoplastic bag comprising:

a front panel and a back panel defined in a single piece of thermoplastic film, the front panel and back panel joined at a bottom edge defined by a fold in the single piece of thermoplastic film, the front panel and back panel joined by a first side seal generally along a first side edge and by a second side seal generally along a second side edge, the first side seal having a first side seal width and the second side seal having a second side seal width, a distance from the first side seal to the second side seal defining a bag width, a folded over upper portion of the front panel defining a folded upper edge, the folded upper edge defining an upper opening of the thermoplastic bag, the thermoplastic bag defining a single open compartment extending from the upper opening to the bottom edge, a first hem and a first overlap area defined between the folded over upper portion and the front panel, the first overlap area below the first hem, a first hem seal between the first hem and the first overlap area, the first hem seal extending generally from the first side seal to the second side seal and having a first hem seal length, a first hem height extending from the folded upper edge to the first hem seal, a first lower seal proximate to a distal edge of the folded over upper portion, the first lower seal sealing the folded over upper portion to the front panel, the first lower seal extending generally from the first side seal to the second side seal and having a first lower seal length, the first lower seal below the first hem seal and above the distal edge of the folded over upper portion, the distal edge of the folded over upper portion above and separate from the bottom edge, a first overlap height extending from the first hem seal to the distal edge of the folded over upper portion, the first overlap height greater than the first hem height, a first total seal length defined by summation of the first hem seal length and the first lower seal length, the first total seal length greater than the bag width, a first drawstring disposed within the first hem, and a first enclosed overlap area defined by the first overlap area, the front panel, the first hem seal and the first lower seal, the first enclosed overlap area devoid of a drawstring.

2. The thermoplastic bag of claim 1 further comprising:

the first hem seal length and the first lower seal length each generally equal to the bag width.

3. The thermoplastic bag of claim 1 further comprising:

the width of the first short seal greater than the width of the second side seal.

4. The thermoplastic bag of claim 1 further comprising:

a second short seal anchoring the first drawstring to the first hem proximate to the second side seal, the second short seal having a width greater than the second side seal width, a height of the second short seal less than a height from the folded upper edge to the first lower seal.

5. The thermoplastic bag of claim 4 further comprising:

the width of the second short seal greater than the first side seal width.

6. A thermoplastic bag comprising:

a front panel and a back panel defined in a single piece of thermoplastic film, the front panel and back panel joined at a bottom edge defined by a fold in the single piece of thermoplastic film, the front panel and back panel joined by a first side seal generally along a first side edge and by a second side seal generally along a second side edge, a distance from the first side seal to the second side seal defining a bag width, a folded over upper portion of the front panel defining a folded upper edge, the folded upper edge defining an upper opening of the thermoplastic bag, the thermoplastic bag defining a single open compartment extending from the upper opening to the bottom edge, a first hem and a first overlap area defined between the folded over upper portion and the front panel, the first overlap area below the first hem, a first hem seal between the first hem and the first overlap area, the first hem seal extending generally from the first side seal to the second side seal and having a first hem seal length, a first hem height extending from the folded upper edge to the first hem seal, a first lower seal proximate to a distal edge of the folder over upper portion, the first lower seal sealing the folded over upper portion to the front panel, the first lower seal extending generally from the first side seal to the second side seal and having a first lower seal length, the first lower seal below the first hem seal and above the distal edge of the folded over upper portion, the distal edge of the folded over upper portion above and separate from the bottom edge, a first overlap height extending from the first hem seal to the distal edge of the folded over upper portion, the first overlap height greater than the first hem height, a total seal length defined by summation of the first hem seal length and the first lower seal length, the total seal length greater than the bag width, a first drawstring disposed within the first hem, a first drawstring cutout defined within the first hem between the first side seal and the second side seal, the first drawstring accessible only via the first drawstring cutout, and a first enclosed overlap area defined by the first overlap area, the front panel, the first hem seal and the first lower seal, the first enclosed overlap area devoid of a drawstring.

7. The thermoplastic bag of claim 6 further comprising:

the first overlap height at least twice the first hem height.

8. The thermoplastic bag of claim 6 further comprising:

the first hem seal length and the second seal length both generally equal to the bag width.

9. The thermoplastic bag of claim 6 further comprising:

the first drawstring cutout located centrally between the first side seal and the second side seal.

10. The thermoplastic bag of claim 6 further comprising:

a first short seal permanently anchoring the first drawstring within the first hem proximate to the first side seal and a second short seal permanently anchoring the first drawstring within the first hem proximate to the second side seal.

11. A thermoplastic bag comprising:

a front panel and a back panel defined in a single piece of thermoplastic film, the front panel and back panel joined at a bottom edge defined by a fold in the single piece of thermoplastic film, the front panel and back panel joined by a first side seal generally along a first side edge and by a second side seal generally along a second side edge, a distance from the first side seal to the second side seal defining a bag width, a folded over upper portion of the front panel defining a folded upper edge, the folded upper edge defining an upper opening of the thermoplastic bag, a first hem and a first overlap area defined between the folded over upper portion and the front panel, the first overlap area below the first hem, a first hem seal between the first hem and the first overlap area, the first hem seal extending generally from the first side seal to the second side seal and having a first hem seal length, a first hem height extending from the folded upper edge to the first hem seal, a first lower seal proximate to a distal edge of the folder over upper portion, the first lower seal sealing the folded over upper portion to the front panel, the first lower seal extending generally from the first side seal to the second side seal and having a first lower seal length, the first lower seal below the first hem seal and above the distal edge of the folded over upper portion, the distal edge of the folded over upper portion above and separate from the bottom edge, a first overlap height extending from the first hem seal to the first lower seal, the first overlap height greater than the first hem height, a total seal length defined by summation of the first hem seal length and the first lower seal length, the total seal length greater than the bag width, a first drawstring disposed with the first hem, a first short seal and a second short seal permanently anchoring the first drawstring within the first hem, the first short seal proximate to the first side seal and the second short seal proximate to the second side seal, and a first enclosed overlap area defined by the first overlap area, the front panel, the first hem seal and the first lower seal, the first enclosed overlap area devoid of a drawstring.

12. The thermoplastic bag of claim 11 further comprising:

the first hem seal length generally equal to the bag width.

13. The thermoplastic bag of claim 11 further comprising:

a width of the first short seal greater than a width of the first side seal.

14. The thermoplastic bag of claim 11 further comprising:

a first drawstring cutout defined within the first hem between the first side seal and the second side seal, the first drawstring accessible only via the first drawstring cutout.

15. A thermoplastic bag comprising:

a front panel and a back panel defined in a single piece of thermoplastic film, the front panel and back panel joined at a bottom edge defined by a fold in the single piece of thermoplastic film, the front panel and back panel joined by a first side seal generally along a first side edge and by a second side seal generally along a second side edge, a distance from the first side seal to the second side seal defining a bag width, a folded over upper portion of the front panel defining a folded upper edge, the folded upper edge defining an upper opening of the thermoplastic bag, a first hem and a first overlap area defined between the folded over upper portion and the front panel, the first overlap area below the first hem, a first hem seal between the first hem and the first overlap area, the first hem seal extending generally from the first side seal to the second side seal, a first hem height extending from the folded upper edge to the first hem seal, a first lower seal proximate to a distal edge of the folder over upper portion, the first lower seal sealing the folded over upper portion to the front panel, the first lower seal extending generally from the first side seal to the second side seal, the first lower seal continuous from the first side seal to the second side seal, the first lower seal below the first hem seal and above the distal edge of the folded over upper portion, the distal edge of the folded over upper portion above and separate from the bottom edge, a first overlap height extending from the first hem seal to the distal edge of the folded over upper portion, the first overlap height greater than the first hem height, a first drawstring disposed within the first hem, the first drawstring sealed to the front panel and the folded over upper portion of the front panel by the first side seal and the second side seal, the first side seal continuously sealing the front panel, the folded over upper portion, and the rear panel to each other from the folded upper edge to the lower seal, and a first enclosed overlap area defined by the first overlap area, the front panel, the first hem seal and the first lower seal, the first enclosed overlap area devoid of a drawstring.

* * * * *